US007832826B2

(12) United States Patent
Yoshida et al.

(10) Patent No.: US 7,832,826 B2
(45) Date of Patent: Nov. 16, 2010

(54) PRINTING METHOD AND PRINTING APPARATUS

(75) Inventors: Masahiko Yoshida, Shojiri (JP); Tatsuya Nakano, Hata-machi (JP); Bunji Ishimoto, Matsumato (JP); Hirokazu Nunokawa, Masumato (JP); Toru Miyamoto, Shiojiri (JP); Yoichi Kakehashi, Naguya (JP)

(73) Assignee: Seiko Epson Corporation, Tokyo (JP)

( * ) Notice: Subject to any disclaimer, the term of this patent is extended or adjusted under 35 U.S.C. 154(b) by 697 days.

(21) Appl. No.: 11/846,785

(22) Filed: Aug. 29, 2007

(65) Prior Publication Data

US 2008/0094439 A1 Apr. 24, 2008

(30) Foreign Application Priority Data

Aug. 29, 2006 (JP) ..... 2006-232806

(51) Int. Cl.
*B41J 29/393* (2006.01)
*B41J 29/38* (2006.01)

(52) U.S. Cl. ..... 347/19; 347/13

(58) Field of Classification Search ..... 347/19, 347/13

See application file for complete search history.

(56) References Cited

FOREIGN PATENT DOCUMENTS

| | | | |
|---|---|---|---|
| JP | 02-54676 A | | 2/1990 |
| JP | 07-242025 | * | 9/1995 |
| JP | 07-242025 A | | 9/1995 |

* cited by examiner

*Primary Examiner*—Uyen-Chau N Le
*Assistant Examiner*—Kajli Prince
(74) *Attorney, Agent, or Firm*—Sughrue Mion, PLLC

(57) ABSTRACT

A printing method includes by printing a first area in a test pattern using a first print mode, determining a first correction value corresponding to the first print mode for each of the row regions, based on a density measurement value for each of row regions in the first area, by printing a second area in the test pattern using a second print mode for a plurality of cycles of periods that is determined by a combination of the row region and the nozzle, determining a second correction value corresponding to the second print mode for each of the row regions, based on a density measurement value for each of the row regions in the second area, and in a coexistent segment in which certain row regions and other row regions are mixed, correcting an ink ejection amount in each of the row regions using a combined correction value that is obtained as a composition of the first correction value and the second correction value.

9 Claims, 25 Drawing Sheets

212

DATA TABLE OF READ DENSITIES

| ROW REGION NUMBER | YELLOW | | | CYAN | | | LIGHT MAGENTA | | | |
|---|---|---|---|---|---|---|---|---|---|---|
| | DENSITY 1 | DENSITY 2 | DENSITY 3 | DENSITY 1 | DENSITY 2 | DENSITY 3 | DENSITY 1 | DENSITY 2 | DENSITY 3 | DENSITY 1 |
| 1 | XXX | XXX | XXX | XXX | XXX | XXX | XXX | XXX | XXX | XXX |
| 2 | XXX | XXX | XXX | XXX | XXX | XXX | XXX | XXX | XXX | XXX |
| 3 | XXX | XXX | XXX | XXX | XXX | XXX | XXX | XXX | XXX | XXX |
| ⋮ | | | ⋮ | | | | | ⋮ | | |

FIG. 13

152

| |
|---|
| NUMBER OF ROW REGIONS OF FRONT END PROCESS AREA |
| NUMBER OF ROW REGIONS OF NORMAL PROCESS AREA |
| NUMBER OF ROW REGIONS OF REAR END PROCESS AREA |
| NUMBER OF ROW REGIONS OF COEXISTENT SEGMENTS |
| |
| FRONT END PROCESS AREA CORRECTION VALUES |
| NORMAL PROCESS AREA CORRECTION VALUES |
| REAR END PROCESS AREA CORRECTION VALUES |
| |
| |

155

FIG. 14

PRINTING METHOD AND PRINTING APPARATUS

CROSS-REFERENCE TO RELATED APPLICATION

The present application claims priority upon Japanese Patent Application No. 2006-232806 filed on Aug. 29, 2006, which is herein incorporated by reference.

BACKGROUND

1. Technical Field

The present invention relates to printing methods and printing apparatuses.

2. Related Art

In printing apparatuses such as inkjet printers, the density of a test pattern that is printed by the printing apparatus is measured to obtain a measured value, and ink ejection adjustments are carried out based on the obtained measured value (for example, see JP-A-2-54676). Furthermore, some of these printing apparatuses vary the transport amounts when carrying out printing. For example, the printing apparatuses carry out printing by making a transport amount at an end area of a medium smaller than a transport amount at a middle area of the medium (for example, see JP-A-7-242025).

In the middle area of the medium in the transport direction, the combinations of row regions and nozzles Nz are periodical. In contrast to this, in the end areas of the medium in the transport direction, the combinations of row regions and the nozzles Nz tend not to be periodical. As a result, the extent of density correction varies between areas printed using correction values corresponding to the end areas and areas printed using correction values corresponding to the middle area even for correction values obtained from the same test pattern, such that there are cases in which an undesirable difference in density occurs at border areas.

SUMMARY

The invention has been devised in light of these circumstances, and it is a primary advantage thereof to suppress image deterioration at the borders between areas printed using end area correction values and areas printed using middle area correction values.

A primary aspect of the invention, is a printing method, including:

(A) by printing a first area in a test pattern using a first print mode, determining a first correction value corresponding to the first print mode for each of the row regions, based on a first provisional correction value for each of row regions in the first area, the first print mode being a print mode applied to an end area of a medium in a transport direction, and involving repetitively carrying out a movement-and-ejection operation of ejecting ink while moving nozzles in a movement direction that intersects the transport direction and a first transport operation of transporting the medium in the transport direction by a first transport amount, the row regions being a plurality of regions lined up in the transport direction and each being a region in which a dot row is formed along the movement direction by the movement-and-ejection operation, the first provisional correction value being determined based on a density measurement value of each of the row regions in the first area, the first correction value being determined based on a value in which the first provisional correction value is multiplied by an attenuation coefficient, (B) by printing a second area in the test pattern using a second print mode for a plurality of cycles of a period that is determined by a combination of the row region and the nozzle, determining a second correction value corresponding to the second print mode for each of the row regions, based on a second provisional correction value for each of the row regions in the second area, the second print mode being a print mode applied to a middle area of the medium in the transport direction, and involving repetitively carrying out the movement-and-ejection operation and a second transport operation of transporting the medium in the transport direction by a second transport amount, the second provisional correction value being determined based on a density measurement value of each of the row regions in the second area, the second correction value being determined based on a value in which the second provisional correction value is averaged, and (C) in a coexistent segment in which certain row regions and other row regions are mixed, correcting an ejection amount of the ink in each of the row regions using a combined correction value that is obtained as a composition of the first correction value and the second correction value, the certain row regions each being a row region in which the dot row is formed by the first print mode, the other row regions each being a row region in which the dot row is formed by the second print mode.

Other features of the invention will become clear through the accompanying drawings and the following description.

BRIEF DESCRIPTION OF THE DRAWINGS

For a more complete understanding of the invention and the advantages thereof, reference is now made to the following description taken in conjunction with the accompanying drawings.

FIG. 13 is a conceptual diagram of a measurement value data table provided in a process-purpose host computer.

FIG. 14 is a conceptual diagram of a correction value storage section that is provided in a memory of a printer.

DESCRIPTION OF EXEMPLARY EMBODIMENTS

Figure 1:
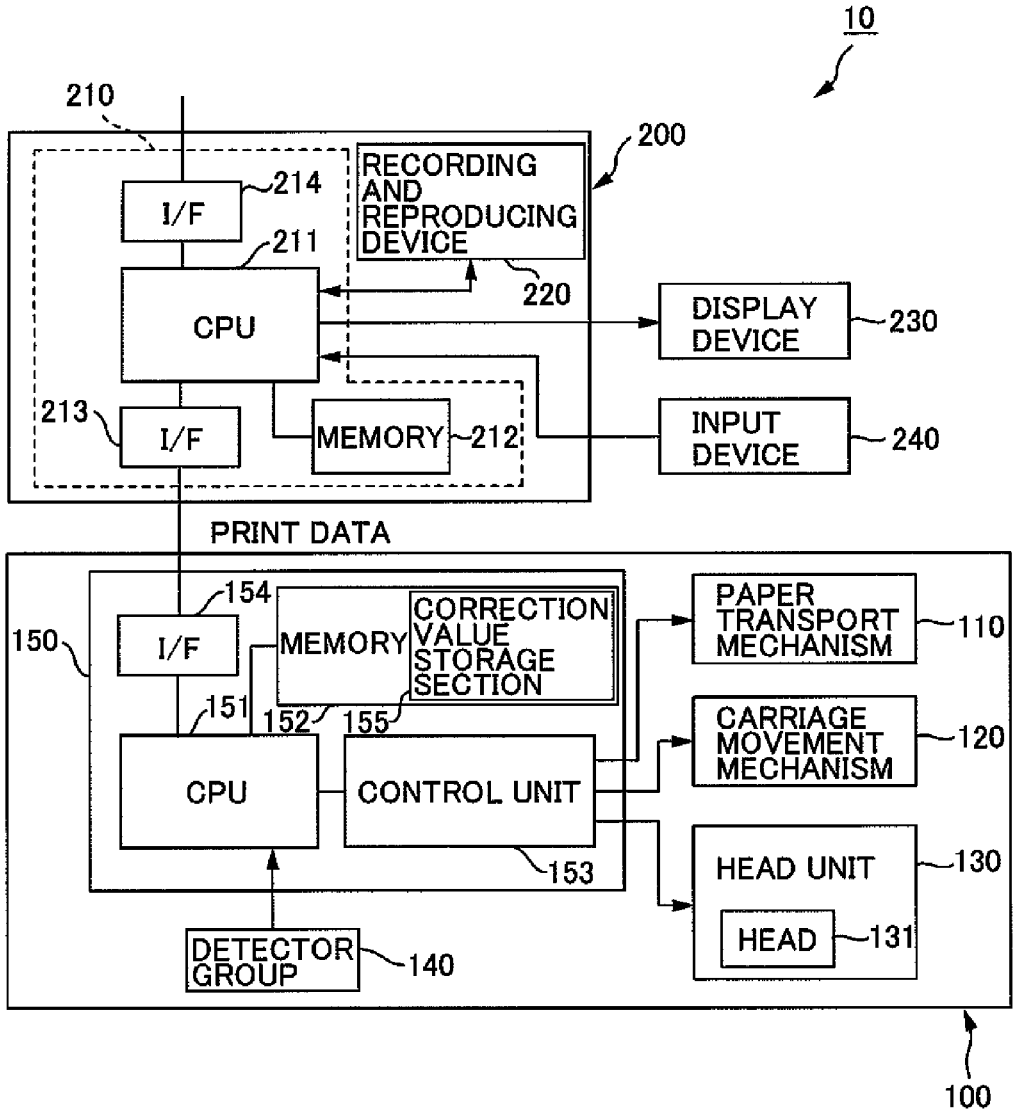
FIG. 1 is a block diagram illustrating a configuration of a printing system.

At least the following matters will be made clear by the description of the present specification and the accompanying drawings.

It will be made clear that a following printing method is achievable.

A printing method, that includes:

(A) by printing a first area in a test pattern using a first print mode, determining a first correction value corresponding to the first print mode for each of the row regions, based on a first provisional correction value for each of row regions in the first area, the first print mode being a print mode applied to an end area of a medium in a transport direction, and involving repetitively carrying out a movement-and-ejection operation of ejecting ink while moving nozzles in a movement direction that intersects the transport direction and a first transport operation of transporting the medium in the transport direction by a first transport amount, the row regions being a plurality of regions lined up in the transport direction and each being a region in which a dot row is formed along the movement direction by the movement-and-ejection operation, the first provisional correction value being determined based on a density measurement value of each of the row regions in the first area, the first correction value being determined based on a value in which the first provisional correction value is multiplied by an attenuation coefficient, (B) by printing a second area in the test pattern using a second print mode for a plurality of cycles of a period that is determined by a combination of the row region and the nozzle, determining a second correction value corresponding to the second print mode for each of the row regions, based on a second provisional correction value for each of the row regions in the second area, the second print mode being a print mode applied to a middle area of the medium in the transport direction, and involving repetitively carrying out the movement-and-ejection operation and a second transport operation of transporting the medium in the transport direction by a second transport amount, the second provisional correction value being determined based on a density measurement value of each of the row regions in the second area, the second correction value being determined based on a value in which the second provisional correction value is averaged, and (C) in a coexistent segment in which certain row regions and other row regions are mixed, correcting an ejection amount of the ink in each of the row regions using a combined correction value that is obtained as a composition of the first correction value and the second correction value, the certain row regions each being a row region in which the dot row is formed by the first print mode, the other row regions each being a row region in which the dot row is formed by the second print mode.

With this printing method, the extent of correction according to the first correction values can be matched to the extent of correction according to the second correction values depending on how the attenuation coefficient is applied. Also, the combined correction value obtained as a composition of the first correction value and the second correction value is applied to the coexistent segment. In this way, image deterioration can be suppressed at the border between the areas printed using the end area correction values and areas printed using the middle area correction values.

In this printing method, the attenuation coefficient by which the first provisional correction value is multiplied is obtained based on a difference between an extent of variance in the first provisional correction values and an extent of variance in the second correction values.

With this method of setting correction values, the extent of correction according to the first correction values can be matched to the extent of correction according to the second correction values such that image deterioration can be suppressed even further.

In this printing method, a composition proportion of the first correction value and the second correction value is determined based on a position of a row region to be corrected in the coexistent segment.

With this method of setting correction values, image deterioration can be suppressed effectively.

In this printing method, the coexistent segment is a segment defined on an end area side of the medium in the transport direction from a middle area in the transport direction, in which a ratio of the other row regions increases the greater the closeness to the middle area, and a proportion of the second correction values is increased more in row regions on a close side to the middle area than in row regions on a far side from the middle area.

With this method of setting correction values, the row regions on the close side to the middle area are more strongly affected by the second correction values than the row regions on the far side from the middle area. Thus, it is possible to make correction appropriate.

In this printing method, the first provisional correction value is determined based on a difference between a density measurement value of a row region targeted for setting and a target density, and the target density is determined based on a plurality of density measurement values for the row regions corresponding to a certain instructed tone value, and the second provisional correction value is determined based on a difference between a density measurement value of a row region targeted for setting and a target density, and the target density is determined based on a plurality of the density measurement values for the row regions corresponding to a certain instructed tone value.

With this method of setting the correction values, the target density is determined based on a plurality of the density measurement values of the row regions, and therefore the accuracy of the correction values to be set can be increased.

In this printing method, the second print mode is a print mode involving repetitively carrying out the movement-and-ejection operation and the second transport operation in which the medium is transported by the second transport amount greater than the first transport amount.

With this method of setting correction values, printing can be carried out using transport amounts appropriate to each area of the medium to be printed.

In this printing method, the nozzles are arranged in the transport direction having a spacing wider than a spacing between the row regions.

With this method of setting correction values, image quality deterioration caused by variance in characteristics of each nozzle can be prevented.

It is also possible to achieve a printing apparatus such as the following.

A printing apparatus, provided with:

(A) a nozzle moving mechanism that causes a plurality of nozzles that eject ink to move in a movement direction, (B) a transport mechanism that transports a medium in a transport direction that intersects the movement direction, (C) a memory for storing a combined correction value obtained as a composition of a first correction value corresponding to a first print mode and a second correction value corresponding to a second print mode, the first print mode being a print mode applied to an end area of the medium in the transport direction, the first correction value being a correction value for correcting an ejection amount of the ink in each of row regions lined up in the transport direction and being determined for each of the row regions based on a value in which a first provisional correction value is multiplied by an attenuation coefficient, the first provisional correction value being determined for each of the row regions based on a density measurement value of each of the row regions in a first area of a test pattern printed using the first print mode, the second print mode being a print mode applied to a middle area of the medium in the transport direction, the second correction value being a correction value for correcting an ejection amount of the ink in each of the row regions and being determined for each of the row regions based on a value in which a plurality of second provisional correction values are averaged, the second provisional correction values being determined based on a density measurement value of each of the row regions in a second area of the test pattern, the second area being an area in which row regions for a plurality of cycles of a period are printed by the second print mode, the period being determined by a combination of the row region and the nozzle, a plurality of the second provisional correction values corresponding to a same nozzle in each cycle of the period, among the plurality of the second provisional correction values, being a target of averaging, and (D) a controller that controls a movement-and-ejection operation and a transport operation, and that corrects an ejection amount of the ink for each of the row regions, the movement-and-ejection operation being an operation in which the ink is ejected while moving the nozzles, the transport operation being an operation in which the medium is transported in the transport direction, the ink ejection amount correction being carried out on a coexistent segment, in which certain row regions and other row regions are mixed, by using the combined correction value, the certain row regions each being a row region in which a dot row is formed along the movement direction by the first print mode, the other row regions each being a row region in which the dot row is formed by the second print mode.

It is also clearly possible to achieve a printing apparatus such as the following.

A printing apparatus, provided with:

(A) a nozzle moving mechanism that causes a plurality of nozzles that eject ink to move in a movement direction, (B) a transport mechanism that transports a medium in a transport direction that intersects the movement direction, (C) a memory for storing a first correction value corresponding to a first print mode and a second correction value corresponding to a second print mode, the first print mode being a print mode applied to an end area of the medium in the transport direction, the first correction value being a correction value for correcting an ejection amount of the ink in each of row regions lined up in the transport direction and being determined for each of the row regions based on a value in which a first provisional correction value is multiplied by an attenuation coefficient, the first provisional correction value being determined for each of the row regions based on a density measurement value of each of the row regions in a first area of a test pattern printed using the first print mode, the second print mode being a print mode applied to a middle area of the medium in the transport direction, the second correction value being a correction value for correcting an ejection amount of the ink in each of the row regions and being determined for each of the row regions based on a value in which a plurality of second provisional correction values are averaged, the second provisional correction values being determined based on a density measurement value of each of the row regions in a second area of the test pattern, the second area being an area in which row regions for a plurality of cycles of a period are printed by the second print mode, the period being determined by a combination of the row region and the nozzle, a plurality of the second provisional correction values corresponding to a same nozzle in each cycle of the period among the plurality of the second provisional correction values being a target of averaging, and (D) a controller that controls a movement-and-ejection operation and a transport operation, and that corrects an ejection amount of the ink for each of the row regions, the movement-and-ejection operation being an operation in which the ink is ejected while moving the nozzles, the transport operation being an operation in which the medium is transported in the transport direction, the ink ejection amount correction being carried out on a coexistent segment, in which certain row regions and other row regions are mixed, by using a combined correction value obtained as a composition of the first correction value and the second correction value, the certain row regions each being a row region in which a dot row is formed along the movement direction by the first print mode, the other row regions each being a row region in which the dot row is formed by the second print mode.

Printing System 10

First, description is given of a printing system 10. The printing system 10 prints images on paper and is provided with an inkjet printer 100 (hereinafter also simply referred to as a printer 100) and a host computer 200, as shown in FIG. 1. Here, a printing apparatus is described. A controller of the printing apparatus performs control based on a printer driver 216 (see FIG. 5) as is described later. For this reason, in a case where the host computer 200 executes the printer driver 216, a combination of the printer 100 and the host computer 200 corresponds to the printing apparatus. Furthermore, in a case where a printer-side controller 150 has the same functionality as the printer driver 216, that is, in a case where the printer 100 can perform printing by itself to paper S, the printer 100 corresponds to the printing apparatus.

Printer 100

The printer 100 includes a paper transport mechanism 110, a carriage movement mechanism 120, a head unit 130, a detector group 140, and the printer-side controller 150.

Figure 2:
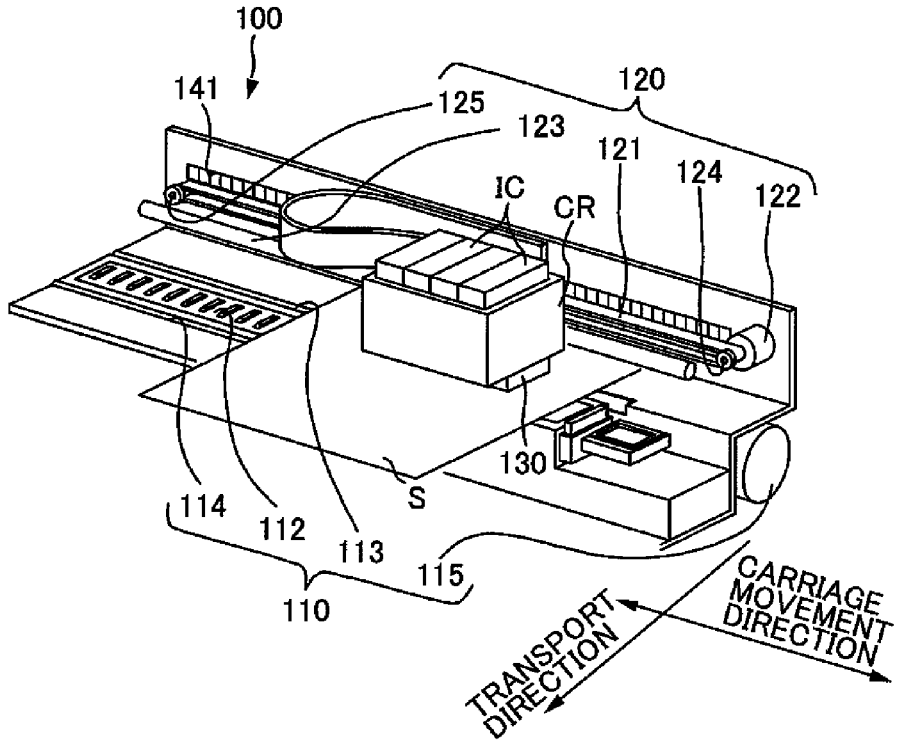
FIG. 2 is a perspective view for describing the configuration of a printer.
Figure 3:
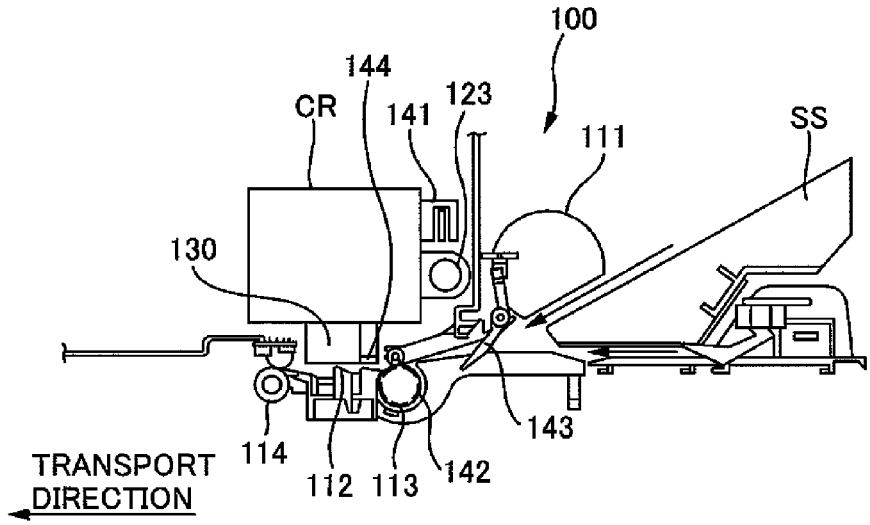
FIG. 3 is a side view for describing the configuration of the printer.

The paper transport mechanism 110 corresponds to a transport mechanism for transporting a medium in a transport direction. The transport direction is a direction that intersects a carriage movement direction described next. As shown in FIGS. 2 and 3, the paper transport mechanism 110 includes a paper feed roller 111 arranged in a predetermined position above a paper stacker SS, a platen 112 that supports the paper S from an underneath side, a transport roller 113 arranged on an upstream side in the transport direction from the platen 112, a discharge roller 114 arranged on a downstream side in the transport direction from the platen 112, and a transport motor 115 that is a drive source of the transport roller 113 and the discharge roller 114. In the paper transport mechanism 110, the paper S held in the paper stacker SS is fed sheet by sheet by the paper feed roller 111. And the paper S is fed to the platen 112 side by the transport roller 113, then after printing, the paper S is fed in the transport direction by the discharge roller 114.

The carriage movement mechanism 120 is for moving a carriage CR in the carriage movement direction. The carriage CR is a component to which ink cartridges IC and the head unit 130 are attached. And the carriage movement direction includes a movement direction from one side to the other side and a movement direction from the other side to the one side. Here the head unit 130 is provided with a plurality of nozzles Nz (see FIG. 4). Consequently, the carriage movement mechanism 120 corresponds to a nozzle moving mechanism, and the carriage movement direction corresponds to a movement direction of the nozzles. The carriage movement mechanism 120 includes a timing belt 121, a carriage motor 122, a guide shaft 123, a drive pulley 124, and an idler pulley 125. The timing belt 121 is connected to the carriage CR, and is stretched between the drive pulley 124 and the idler pulley 125. The carriage motor 122 is a driving source for rotating the drive pulley 124. The guide shaft 123 is a component for guiding the carriage CR in the carriage movement direction. In the carriage movement mechanism 120, it is possible to move the carriage CR in the carriage movement direction by operating the carriage motor 122.

Figure 4:
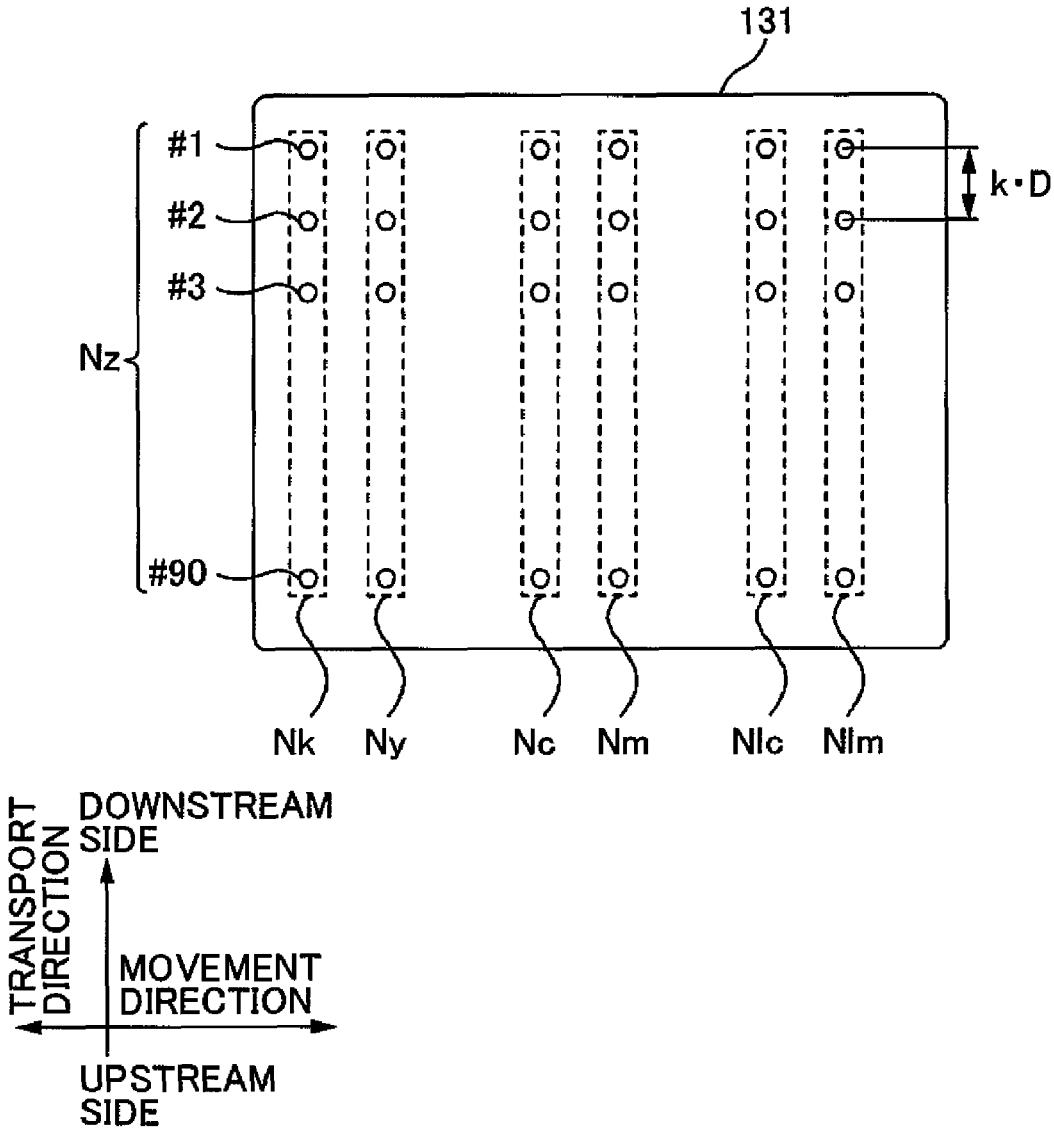
FIG. 4 is a diagram for describing an arrangement of nozzles in a head.

The head unit 130 has a head 131 for ejecting ink toward the paper S. In a state attached to the carriage CR, the head 131 faces the platen 112. As shown in FIG. 4, a plurality of the nozzles Nz for ejecting ink are provided in the head 131 on a surface (nozzle face) opposing the platen 112. These nozzles Nz are divided into groups according to types of the ink to be ejected, with each group constituting a nozzle row. That is, the nozzle rows correspond to nozzle groups constituted by a plurality of nozzles Nz that eject the same type ink. The head 131 illustratively shown has a black ink nozzle row Nk, a yellow ink nozzle row Ny, a cyan ink nozzle row Nc, a magenta ink nozzle row Nm, a light cyan ink nozzle row Nlc, and a light magenta ink nozzle row Nlm. And these nozzle rows Nk to Nlm are arranged in an attached state in the head 131 in positions shifted in the carriage movement direction.

Each nozzle row has n (n=90, for example) nozzles Nz. The plurality of nozzles Nz pertaining to a single nozzle row are arranged at a constant spacing (nozzle pitch: k·D) in the transport direction. Here, D is a minimum dot pitch in the transport direction, that is, a spacing at the highest resolution of dots formed on the paper S. Moreover, k is a coefficient indicating a relationship between the minimum dot pitch D and the nozzle pitch, and is set to an integer of 1 or more. For example, if the nozzle pitch is 180 dpi (a spacing of $1/180$ inch) and the dot pitch in the transport direction is 720 dpi ($1/720$ inch), then k=4. Furthermore, it is possible to eject ink (ink droplets) in differing quantities from each of the nozzles Nz.

Thus, a configuration is adopted such that nozzle rows are formed in which a plurality of nozzles Nz are arranged along the transport direction, and that a plurality of these nozzle rows are provided in different positions in the movement direction and eject inks of different colors respectively. In this manner, many types (colors) of ink can be ejected even with a limited range of nozzle arrangement surface.

The detector group 140 is for monitoring conditions inside the printer 100. As shown in FIGS. 2 and 3, the detector group 140 includes a linear encoder 141, a rotary encoder 142, a paper detector 143, and a paper width detector 144.

The printer-side controller 150 carries out control of the printer 100 and includes a CPU 151, a memory 152, a control unit 153, and an interface section 154. The CPU 151 is a processing unit for carrying out overall control of the printer 100. The memory 152 is for reserving an area for storing programs for the CPU 151 and a working area, for example, and is constituted by a storage device such as a RAM, an EEPROM, or a ROM. The CPU 151 controls the control target sections via the control unit 153 in accordance with computer programs stored in the memory 152. Accordingly, the control unit 153 outputs various signals based on commands from the CPU 151. Along with a host-side controller 210, the printer-side controller 150 corresponds to a controller that performs control of a movement-and-ejection operation, in which ink is ejected while the nozzles Nz are moved in the carriage movement direction, and a transport operation, in which the paper S is transported in the transport direction. That is, the printer-side controller 150 commands direct control over various sections of the printer 100, and the host-side controller 210 commands image density corrections (corrections of ink ejection amounts) based on correction values. Furthermore, a region of part of the memory 152 is used as a correction value storage section 155. The correction value storage section 155 stores correction values (which are to be described later) used in correcting for each row region the density of an image to be printed.

Host Computer 200

The host computer 200 includes the host-side controller 210, a recording and reproducing device 220, a display device 230, and an input device 240. Among these, the host-side controller 210 includes a CPU 211, a memory 212, a first interface section 213, and a second interface section 214. The CPU 211 is a processing unit for performing overall control of the computer. The memory 212 is for reserving an area for storing computer programs used by the CPU 211 and a working area, for example. And the CPU 211 performs various controls in accordance with the computer programs stored in the memory 212. The first interface section 213 carries out data exchange between itself and the printer 100, and the second interface section 214 carries out data exchange between itself and external devices (a scanner, for example) other than the printer 100.

Figure 5:
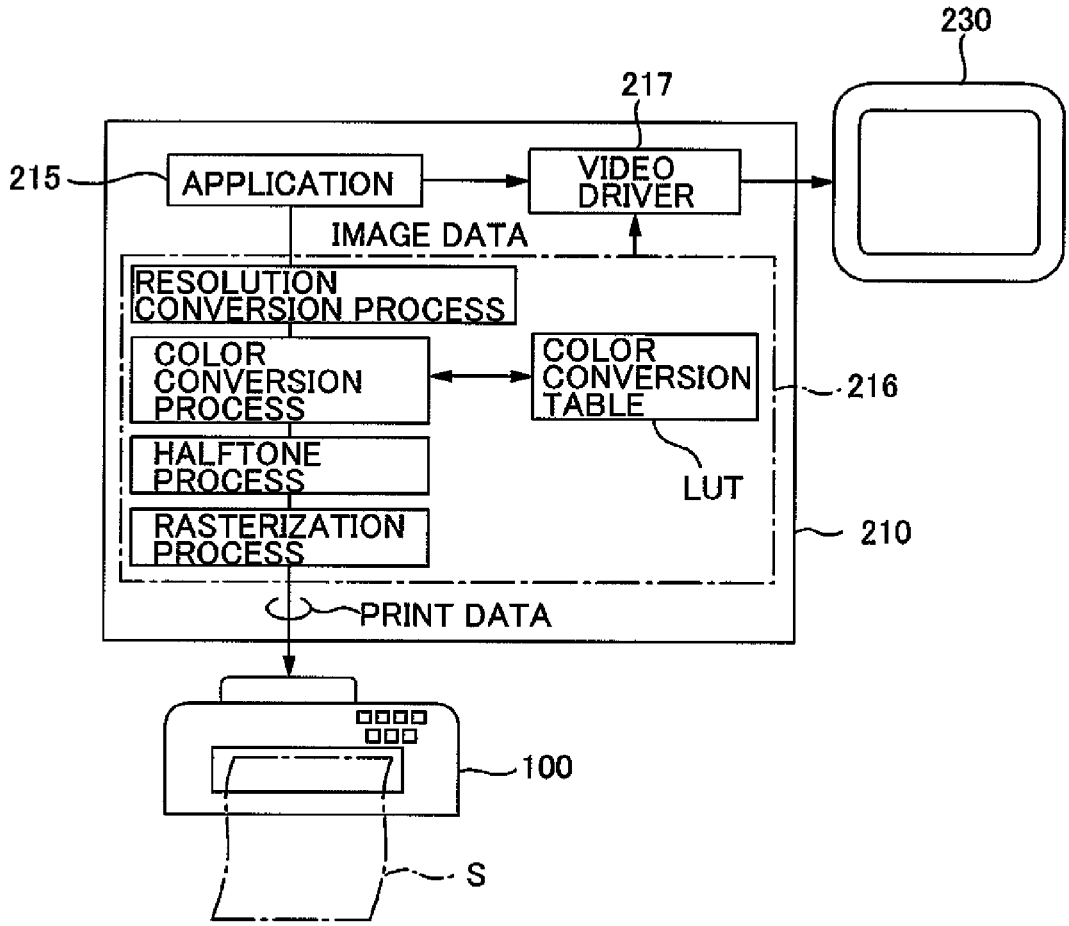
FIG. 5 is a schematic diagram for describing a computer program that is stored in a memory of a host computer.

Examples of computer programs stored in the memory 212 of the host-side controller 210 include an application program 215, the printer driver 216, and a video driver 217 as shown in FIG. 5 for example. The application program 215 is for causing the host computer 200 to carry out a desired operation. The printer driver 216 is for controlling the printer 100 and, for example, generates print data based on image data from the application program 215 and sends this to the printer 100. The video driver 217 is for displaying display data from the application program 215 or the printer driver 216 on the display device 230.

Here, description is given regarding the print data that is sent from the printer driver 216. The print data is data having a format that can be interpreted by the printer 100, and includes various types of command data, and dot formation data. The command data is data for directing the printer 100 to execute a specific operation. The command data includes data such as feed data for directing that paper be fed, transport amount data for indicating transport amounts, and discharge data for directing discharge of the paper. Furthermore, the dot formation data is data relating to dots that are to be formed on the paper S (data for dot color and dot size, for example). The dot formation data is constituted by a plurality of dot tone values defined for each unit region. Unit region refers to a rectangular region that is virtually defined on a medium such as the paper S, and its size and shape are determined based on the print resolution. For example, if the print resolution is 720 dpi (the carriage movement direction)×720 dpi (the transport direction), the unit region is a square region of approximately 35.28 μm×35.28 μm (≈1/720 inch×1/720 inch). A dot tone value indicates a size of a dot to be formed in the unit region. In this printing system 10, the dot tone values are constituted by 2-bit data. Thus, control over four tones can be achieved when forming a dot in a single unit region.

Printing Operation

Operation of Host Computer 200 Side

A printing operation is carried out for example by a user executing a print command in the application program 215. When a print command of the application program 215 is executed, the host-side controller 210 generates image data targeted for printing. This image data is converted to print data by the host-side controller 210, which executes the printer driver 216. The conversion to print data is achieved by a resolution conversion process, a color conversion process, a halftone process, and a rasterization process. Accordingly, the printer driver 216 includes code for carrying out these processes.

The resolution conversion process is a process of converting the resolution of the image data to a print resolution. It should be noted that print resolution refers to a resolution when printing on the paper S. The color conversion process is a process for converting pieces of RGB pixel data of RGB image data into CMYK pixel data having tone values of multiple gradations (for example, 256 grades) expressed in a CMYK color space. This color conversion process is performed by referencing a table (a color conversion lookup table LUT) in which RGB tone values are associated with CMYK tone values. The printer 100 carries out printing using inks of six colors, namely cyan (C), light cyan (LC), magenta (M), light magenta (LM), yellow (Y), and black (K). Thus, data is generated for each of these colors respectively in the color conversion process. It should be noted that the correction values stored in the correction value storage section 155 are used in the color conversion process (which is described later).

Figure 6:
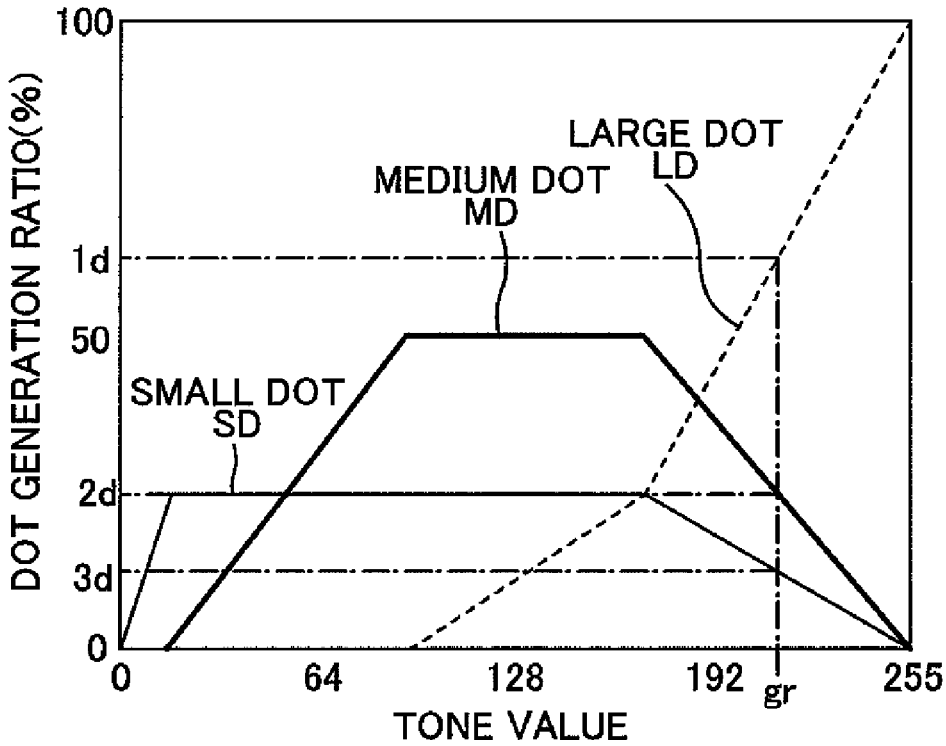
FIG. 6 is a diagram for schematically describing halftone processing.

The halftone process is a process for converting CMYK pixel data having tone values of multiple gradations into dot tone values having fewer gradations of tone values that can be expressed in the printer 100. Specifically, for each unit region, a tone value is determined of one of the four tone values of "no dot formation", "small dot formation", "medium dot formation", and "large dot formation". The generation ratio of each of these dots is determined corresponding to the tone value. For example, as shown in FIG. 6, in a unit region in which a tone value gr is specified, the large dot formation ratio is 1d, the medium dot formation ratio is 2d, and the small dot formation ratio is 3d. In the halftone process, methods such as dithering, gamma correction, and error diffusion are used. The rasterization process is a process for changing the dot tone values that have been obtained by the halftone process into a data order for transfer to the printer 100. In this manner, dot formation data is generated for the respective colors. The dot formation data constitutes print data along with the above-mentioned command data, and is sent to the printer 100.

Operation of Printer 100 Side

On the printer 100 side, the printer-side controller 150 carries out various processes based on the received print data. It should be noted that the various processes on the printer 100 side to be described below are achieved by the printer-side controller 150 executing computer programs stored on the memory 152. Consequently, the computer programs include code for executing the various processes.

Figure 7:
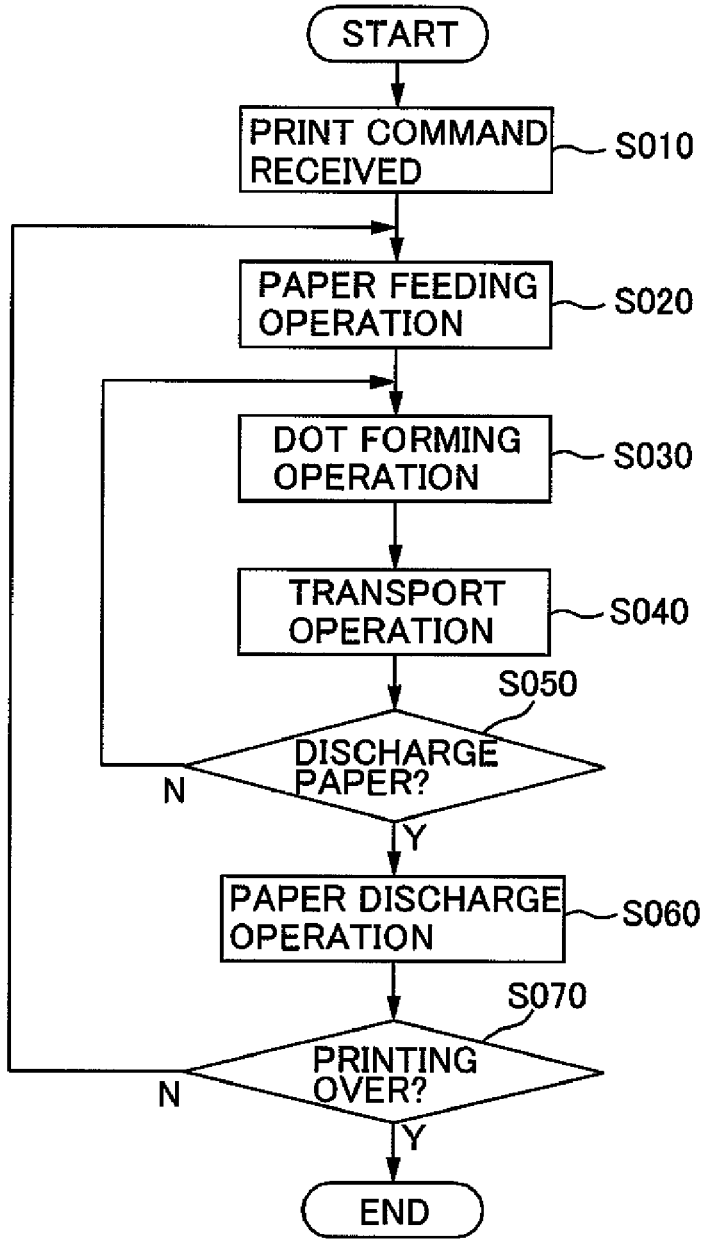
FIG. 7 is a flowchart illustrating a printing operation on a printer side.

As shown in FIG. 7, upon receiving a print command in the print data (S010), the printer-side controller 150, carries out a paper feeding operation (S020), a dot forming operation (S030), a transport operation (S040), a paper discharge determination (S050), a paper discharge operation (S060), and a printing finished determination (S070). The paper feeding operation is an operation for feeding the paper S to be printed to be positioned at a print start position (also referred to as the "indexing position"). In the paper feeding operation, the printer-side controller 150 drives the transport motor 115 to rotate the paper feed roller 111 and the transport roller 113. The dot forming operation is an operation for forming dots on the paper S. In this dot forming operation, the printer-side controller 150 drives the carriage motor 122, or outputs control signals to the head 131. In this way, each of the nozzles Nz moves together with the carriage CR and ink is intermittently ejected. This dot forming operation corresponds to the movement-and-ejection operation in which ink is ejected while the plurality of nozzles Nz are moved. The transport operation is an operation for moving the paper S in the transport direction. In the transport operation, the printer-side controller 150 drives the transport motor 115 to rotate the transport roller 113 and the discharge roller 114. By this transport operation, dots can be formed at positions that are different from those dots formed in the previous dot forming operation. The paper discharge determination is an operation to determine whether or not to discharge the paper S that is being printed. The paper discharge operation is a process to cause the paper S to be discharged, which is carried out on the condition that the determination made in the preceding paper discharge determination is "should be discharged". In this paper discharge process, the printer-side controller 150 drives the transport motor 115 to rotate the transport roller 113 and the discharge roller 114. The printing finished determination is to determine whether or not to continue printing.

Printing of an image on the paper S is carried out by repeating the dot forming operation (S030) and the transport operation (S040) in alternation. Dots are formed on the paper S when ink ejected from the nozzles Nz lands on the paper S. In this way, a row of dots (hereinafter also referred to as a "raster line") composed of a plurality of dots lined up in the carriage movement direction is formed on the surface of the paper S. And the dot forming operation and the transport operation are repeated in alternation, and therefore a plurality of raster lines are formed in the transport direction. In this manner, it can be said that the image printed on the paper S is constituted by a plurality of raster lines adjacent to one another in the transport direction.

Interlaced Printing

The printer 100 prints images by ejecting ink while moving the nozzles Nz. In this regard, each section of the nozzles Nz or the like is subject to certain variance caused when processing or assembling the same. Due to this variance, the characteristics such as flying trajectory or ejection amount of ink (hereinafter also referred to as "ejection characteristics") also vary. In order to mitigate the variance of the ejection characteristics, printing by the interlace mode (hereinafter also referred to as "interlaced printing") is performed. Interlaced printing refers to a printing scheme in which raster lines that are not recorded are sandwiched between raster lines that are recorded in a single pass. And "pass" refers to a single dot forming operation, that is, a single movement-and-ejection operation. By carrying out this interlaced printing, the variance in the ejection characteristics of the nozzles Nz is ameliorated, and thus the quality of the image is improved. Furthermore, printing of images can be performed at a finer resolution D than the nozzle pitch (k·D). That is, high quality images can be printed using the head 131 having a nozzle pitch wider than the printing resolution.

Figure 8:
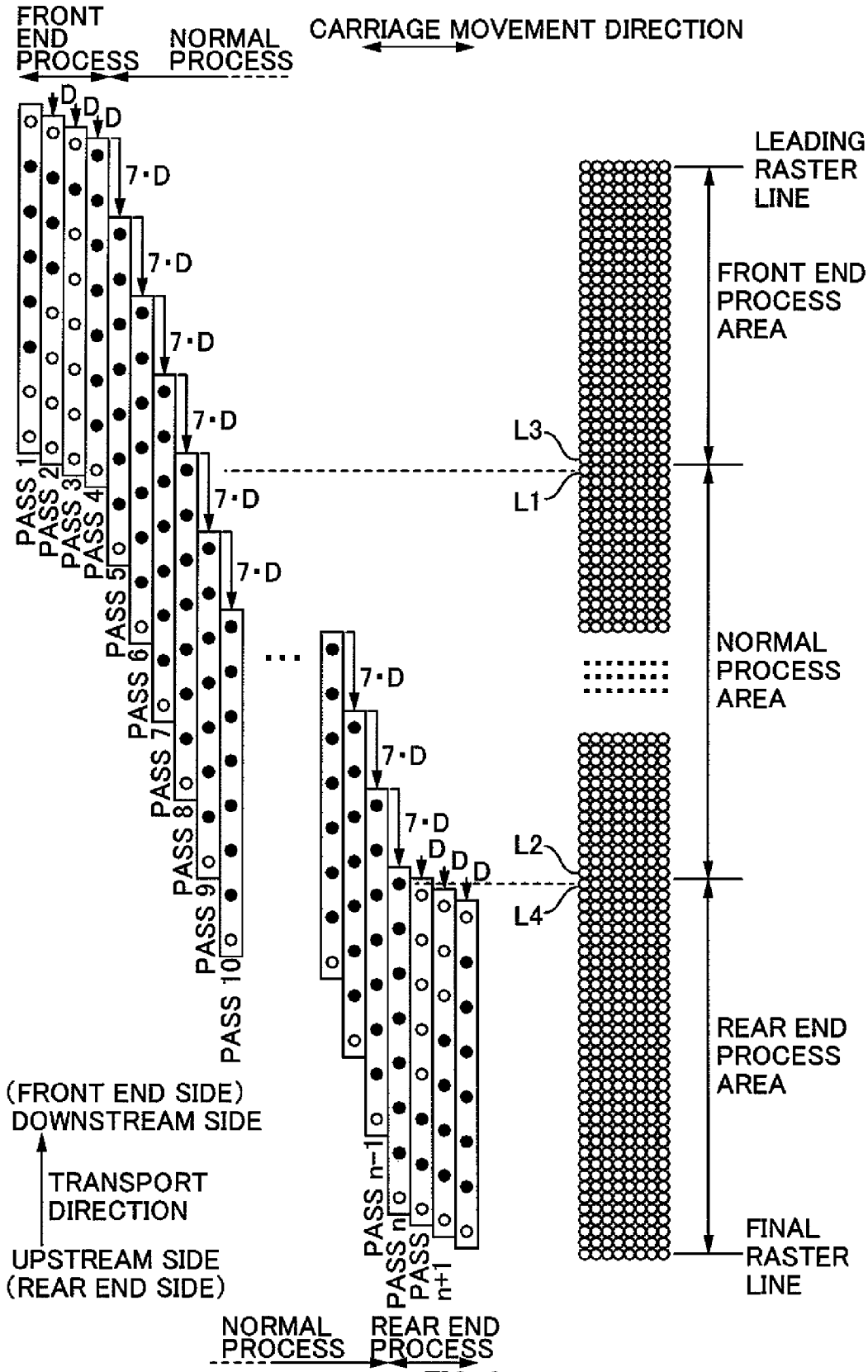
FIG. 8 is a diagram describing an example of interlaced printing.

In the example of interlaced printing shown in FIG. 8, in order to facilitate description, a single nozzle row is shown having eight nozzles Nz. Moreover, the nozzle rows are illustrated as moving with respect to the paper S, but the figure shows a relative positional relationship of the nozzle rows to the paper S. That is, in the actual printer 100, the paper S is moved in the transport direction. In interlaced printing, a front end process, a normal process, and a rear end process are performed. The front end process is a printing method suitable for the front end area of the paper S (the downstream end area in the transport direction), and compared to the normal process, printing is performed by transporting the paper S using smaller transport amounts. In this example, the transport amount is set as 1·D and four-pass dot forming operations are carried out. And a single raster line is formed in a single pass. For example, a first raster line (leading raster line) is formed by ink ejected from a first nozzle Nz(#1) in the fourth pass. Furthermore, a second raster line to a fifth raster line are formed by ink ejected from a second nozzle Nz(#2).

The normal process is a printing method suitable for the middle area, excluding the front end area and the rear end area (upstream end area) of the paper S. In the normal process, every time the paper S is transported in the transport direction by a constant transport amount, the nozzles Nz record a raster line just above the raster line that was recorded in the immediately preceding pass. In order to perform the recording at a constant transport amount in this manner, it is required that the following conditions are satisfied. Namely, it is required to satisfy the conditions (1) the number N (integer) of nozzles that can eject ink is coprime to the coefficient k, and (2) the transport amount F is set to N·D (D: the spacing at the highest resolution in the transport direction). In this case, N=7, k=4 and F=7-D are set so as to satisfy these conditions (D=720 dpi). With respect to the raster line groups formed in the normal process, there is a periodicity in the combination of the nozzles Nz used to form each raster line. That is, raster lines formed by the same combination of the nozzles Nz appear every certain predetermined number of raster lines (this is described later).

The rear end process is a printing method suitable for the rear end area of the paper S, and compared to the normal process, printing is performed by transporting the paper S by smaller transport amounts. In the example of FIG. 8, the transport amount is set as 1·D and four-pass dot forming operations are carried out.

In interlaced printing, the front end process, the normal process, and the rear end process are carried out and the transport amounts respectively suitable therefor are set. For this reason, printing can be carried out by a procedure suited to the positions of the paper S. For example, the transport amounts for the end areas of the paper S can be made smaller than for the middle area of the paper S so as to prevent deterioration in image quality caused by transport variance. Also, for the middle area of the paper S, the paper S is transported by a largest transport amount at which the raster lines in each row region can be formed, thereby increasing the speed of the print process.

It should be noted that in the following description, an area in which raster lines are formed using only the normal process is referred to as a normal process area. In the example of FIG. 8, raster lines on the upstream side from the raster line L1 formed by the nozzle Nz(#1) in the eighth pass pertain to the normal process area. Furthermore, the raster lines (until the raster line L2) on the downstream side from the raster line L4 formed by the nozzle Nz(#1) in the n-th pass (the final transport operation using the transport amount 7·D) pertain to the normal process area. And a front end process area and a rear end process area are constituted by raster lines pertaining to regions other than regions of the normal process area. That is, the front end process area is constituted by the plurality of raster lines from a raster line L3 adjacent to raster line L1 on the downstream side to the leading raster line. Similarly, the rear end process area is constituted by the raster lines from a raster line L4 to the final raster line. Consequently, the front end process area has a segment constituted by only raster lines formed by the front end process and a segment in which raster lines formed by the front end process and raster lines formed by the normal process are mixed. Similarly, the rear end process area has a segment constituted by only raster lines formed by the rear end process and a segment in which raster lines formed by the rear end process and raster lines formed by the normal process are mixed. It should be noted that these segments are described later.

Correction Values

Density Non-Uniformities in Printed Images

As described above, in the printer 100, an image is printed by repeating the dot forming operation and the transport operation. Furthermore, when interlaced printing is performed, the ejection characteristics of the respective nozzles Nz are moderated, and thus the image quality is improved. However, recent demand for higher image quality is so strong that further improvement of image quality is demanded for images obtained by interlaced printing. Here, description is given concerning density non-uniformity (banding) in printed images, which is a cause of deterioration in quality. The density non-uniformities can be recognized as bands (for convenience, also referred to as lateral bands) running parallel to the carriage movement direction. In other words, density non-uniformities occur in the transport direction of the paper S.

Figure 9A:
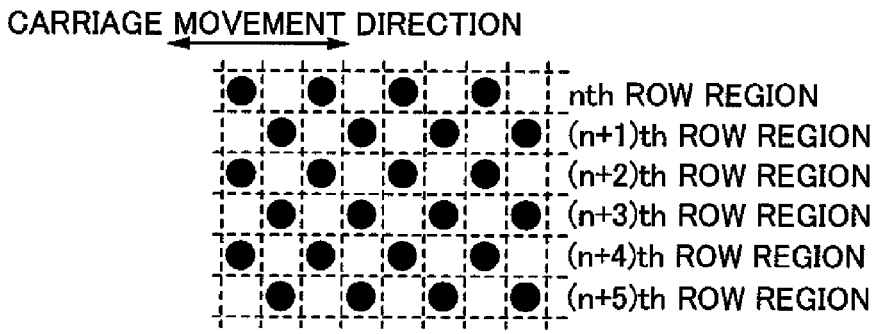
FIG. 9A is a diagram for describing a dot group formed with ideal ejection characteristics.

In the example shown in FIG. 9A, since the ejection characteristics are ideal, ink ejected from the nozzles Nz lands on the unit region virtually defined on the paper S with good location accuracy. Specifically, a center of the unit region and a center of the dot coincide. And a raster line is constituted by a plurality of dots lined up in the carriage movement direction. In this example, when the image density of the printed image is compared using the row region as a unit, the image density of each row region is consistent. Here, "row region" refers to a region constituted by a plurality of unit regions arranged in the movement direction of the nozzles Nz (the carriage movement direction). For example, if the print resolution is 720 dpi×720 dpi, the row region is a band-like region with a width of 35.28 μm (≈1/720 inch) in the transport direction. And since an image is constituted by a plurality of raster lines adjacent to one another in the transport direction, the row region is also defined in a plural number adjacent in the transport direction of the paper S (the direction intersecting the carriage movement direction). For the sake of convenience, in the following description, each image divided by the row regions is also referred to as an image piece. Here, the raster line is a line of dots obtained by the landing of ink. On the other hand, the image piece is a piece of the printed image cut on a row region basis. The raster line and the image piece are different in this point.

Figure 9B:
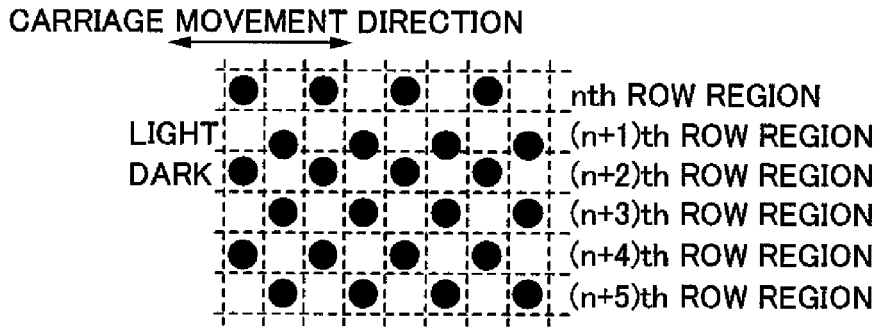
FIG. 9B is a diagram for describing effects of variance in the ejection characteristics.

In the example of FIG. 9B, due to the influence of ejection characteristics, a raster line corresponding to the (n+1)th row region is formed in a position shifted from its normal position to the side of a (n+2)th row region (lower side in FIG. 9B). Due to this, variance is produced in the density of each image piece. For example, the density of the image piece corresponding to the (n+1)th row region is lighter than the density of the image piece corresponding to the standard row region (a nth row region or a (n+3)th row region, for example). Furthermore, the density of the image piece corresponding to the (n+2)th row region is darker than the density of the image piece corresponding to the standard row region.

Figure 10:
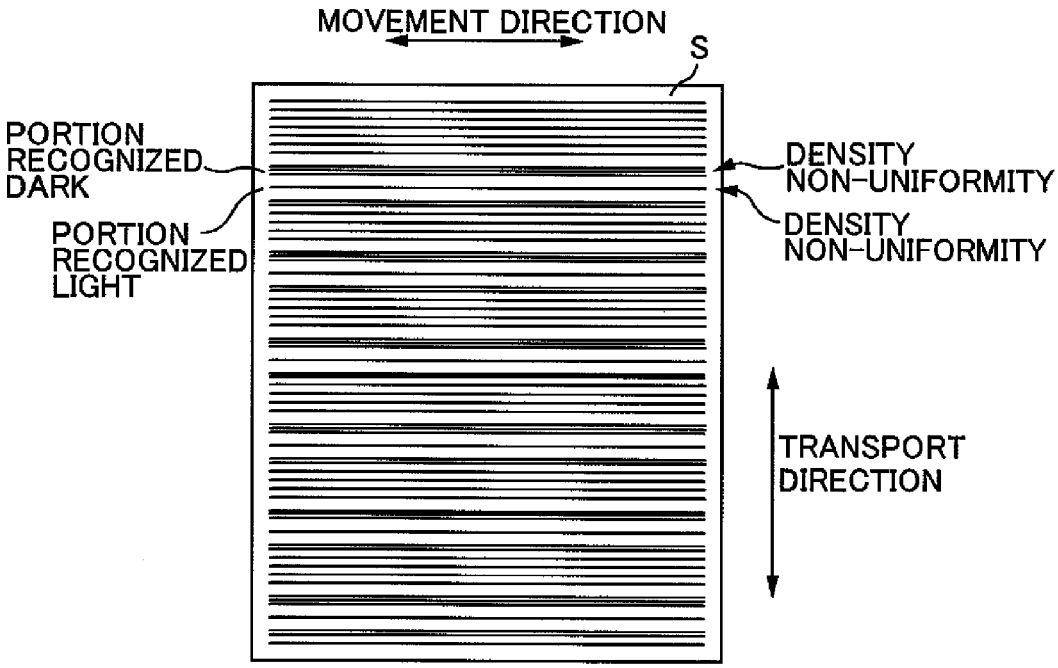
FIG. 10 is a schematic diagram for describing density non-uniformity.

And as shown in FIG. 10, variance in the density of image pieces is recognized as density non-uniformities in the form of lateral bands, as seen macroscopically. In other words, image pieces in an area in which a spacing between the adjacent raster lines is relatively wide macroscopically appear lighter; whereas image pieces in an area in which a spacing between raster lines is relatively narrow macroscopically appear darker. This density non-uniformity causes deterioration of image quality of printed images. It should be noted that the cause of this density non-uniformity also applies to the other ink colors as well. And if there is variance in the density present in even one color of the aforementioned six colors of ink, then the density non-uniformity occurs in images printed by multi-color printing.

Outline of Correction Values

In order to correct this density non-uniformity in each row region, correction values having as a unit the row region in which a raster line is formed are stored in the printer 100 such that correction is performed for the density of the printed image in each row region. For example, for a row region that tends to be recognized as darker than the standard, correction values are stored that are set so as to more lightly form an image piece to constitute that row region. In contrast, for a row region that tends to be recognized as lighter than the standard, correction values are stored that are set so as to more darkly form an image piece to constitute that row region. These correction values are referenced in processing based on the printer driver 216 for example. For example, the CPU 211 of the host computer 200 corrects multi tone CMYK pixel data in the color conversion process based on the correction values. Then the corrected CMYK pixel data is subjected to the halftone process. In short, tone values are corrected based on the correction values. In this way, the ejection amount of ink is adjusted to suppress density inconsistency in the image pieces. It should be noted that in the example of FIG. 9B, the image piece corresponding to the (n+2)th row region becomes darker because the spacing between relevant adjacent raster lines is narrower than the normal spacing. More specifically, the (n+1)th raster line that should be formed in the middle in the transport direction of the (n+1)th row region is shifted toward the (n+2)th row region, and therefore the corresponding image piece becomes darker. For this reason, when the density non-uniformity is considered in reference to the image pieces, it is necessary to consider raster lines formed in adjacent row regions as well. That is, it is necessary to consider the combinations of the nozzles Nz responsible for adjacent row regions.

Figure 11:
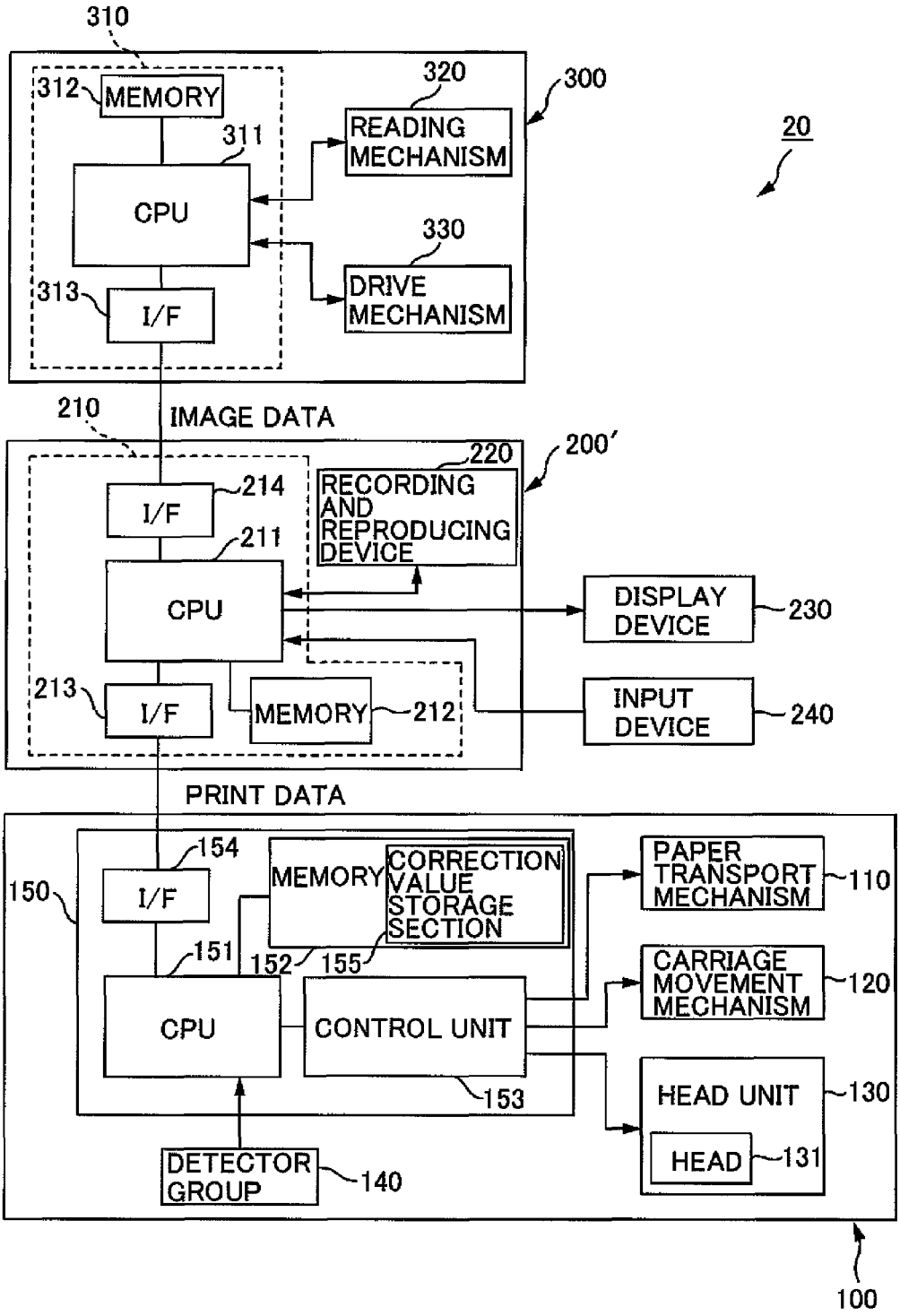
FIG. 11 is a block diagram illustrating a configuration of a correction value setting system.

The correction values for each row region are set based on measured values of density by a scanner 300 (see FIG. 11). For example, in a testing process at a printer manufacturing factory, first a test pattern CP (see FIG. 16) is printed in the printer 100, then a density of the printed test pattern CP is read by the scanner 300. Then, correction values using row region units are obtained based on the measured values (read densities) corresponding to each image piece. The obtained correction values are stored in the correction value storage section 155 of the printer-side controller 150. The printer 100, in which the correction values are stored, is used by a user. When this happens, the host computer 200 connected to the printer 100 (specifically, the host-side controller 210 executing the printer driver 216) uses the correction values read out from the correction value storage section 155 and corrects the multi tone pixel data in each row region. Further still, the host-side controller 210 generates print data based on the corrected tone values. This print data is sent to the printer 100. As a result, the image printed by the printer 100 has high image quality in which lateral bands of density non-uniformity are reduced. That is, density correction can be achieved that integrates variance in the characteristics of the nozzles Nz responsible for adjacent row regions.

In the above-mentioned normal process area, the combinations of row regions and the nozzles Nz are periodical. This is due to the paper S being transported by fixed feed amounts. Thus, the correction values used when printing the normal process area are determined for the number of types corresponding to one period. In the example of FIG. 8, one period corresponds to seven row regions. Thus, in the correction values used when printing the normal process area (for the sake of convenience, these are also referred to as "normal process area correction values"), seven types corresponding to the respective row regions are determined. And the host-side controller 210 that executes the printer driver 216 repetitively applies one group of correction values in the color conversion process. Furthermore, the combinations of the row regions and the nozzles Nz in the front end process area and the rear end process area are not periodic. For this reason, correction values for the respective pluralities of row regions are set for the front end process area and the rear end process area.

In this regard, correction values of one period are set for each row region for the normal process area, and correction values specific to a row region are set for each row region for the front end process area and the rear end process area. In this manner, since the characteristics of the correction values are different, when the correction values of the front end process area, the correction values of the rear end process area, and the correction values of the normal process area are used as they are, the extent of density correction is different in areas corrected using the correction values of the front end process area and the correction values of the rear end process area and areas corrected using the correction values of the normal process area, such that sometimes undesirable differences in density occur at border portions.

Accordingly, in a correction value setting system 20, end area correction values (corresponding to first correction values) and normal process area correction values (corresponding to second correction values) are set by carrying out the following processes (A) to (D).

(A) Printing a first area in a test pattern CP by the front end process and the rear end process (corresponding to a first print mode) applied to end areas in the transport direction of the paper S, in which a dot forming operation and a first transport operation of transporting the paper S by a predetermined transport amount (1·D in the example of FIG. 8) are repetitively carried out.

(B) Printing a second area in the test pattern CP for a plurality of periods that are determined by a combination of the row regions and the nozzles Nz, by the normal process (corresponding to a second print mode) applied in the transport direction of the paper S, in which the dot forming operation and a second transport operation of transporting the paper S by another predetermined transport amount (7·D in the example of FIG. 8) are repetitively carried out.

(C) Determining for each row region, end area provisional correction values (corresponding to first provisional correction values) corresponding to the first area based on the density measurement values of each row region in the first area of the test pattern CP and setting for each row region the end area correction values corresponding to the front end process and the rear end process based on values in which the end area provisional correction values are multiplied by an attenuation coefficient.

(D) Determining for each row region, normal process area provisional correction values (corresponding to second provisional correction values) corresponding to the second area based on the density measurement values of each row region in the second area of the test pattern CP and setting for each row region determined by a combination with the nozzles Nz, the normal process area correction values corresponding to the normal process based on values in which a plurality of the normal process area provisional correction values corresponding to the same nozzles Nz in respective periods are averaged.

By employing this method, the extent of correction according to the end area correction values can be matched to the extent of correction according to the normal process area correction values depending on how the attenuation coefficient, by which the end area provisional correction values are multiplied, is applied. In this way, image deterioration can be suppressed at the border of the areas printed using the end area correction values and areas printed using the normal process area correction values. Hereinafter, this is described in detail.

Correction Value Setting System 20

In giving description concerning the setting of correction values, first the correction value setting system 20 used in setting the correction values is described. As shown in FIG. 11, the correction value setting system 20 is provided with a scanner 300 and a process-purpose host computer 200'.

Scanner 300

The scanner 300 includes a scanner-side controller 310, a reading mechanism 320, and a movement mechanism 330. The scanner-side controller 310 includes a CPU 311, a memory 312, and an interface section 313. The CPU 311 is for performing the overall control of the scanner 300. The CPU 311 is communicably connected to the reading mechanism 320 and the movement mechanism 330. The memory 312 is for reserving an area for storing computer programs and a working area, for example, and is constituted by a RAM, an EEPROM, or a ROM, for example. The interface section 313 is interposed between the process-purpose host computer 200' and the scanner 300 for data exchange. In this embodiment, the interface section 313 of the scanner 300 is connected to a second interface section 214 of the process-purpose host computer 200'.

Figure 12A:
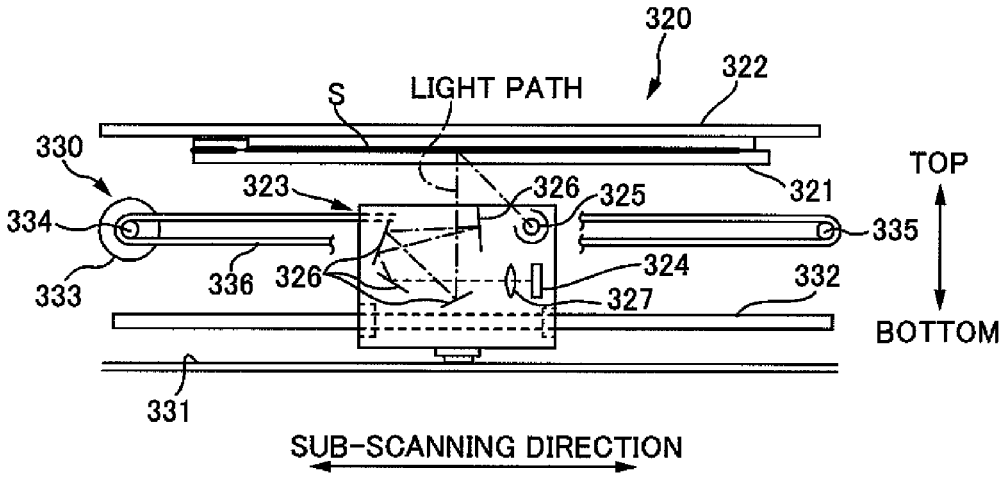
FIG. 12A is a front view for describing a configuration of a scanner.
Figure 12B:
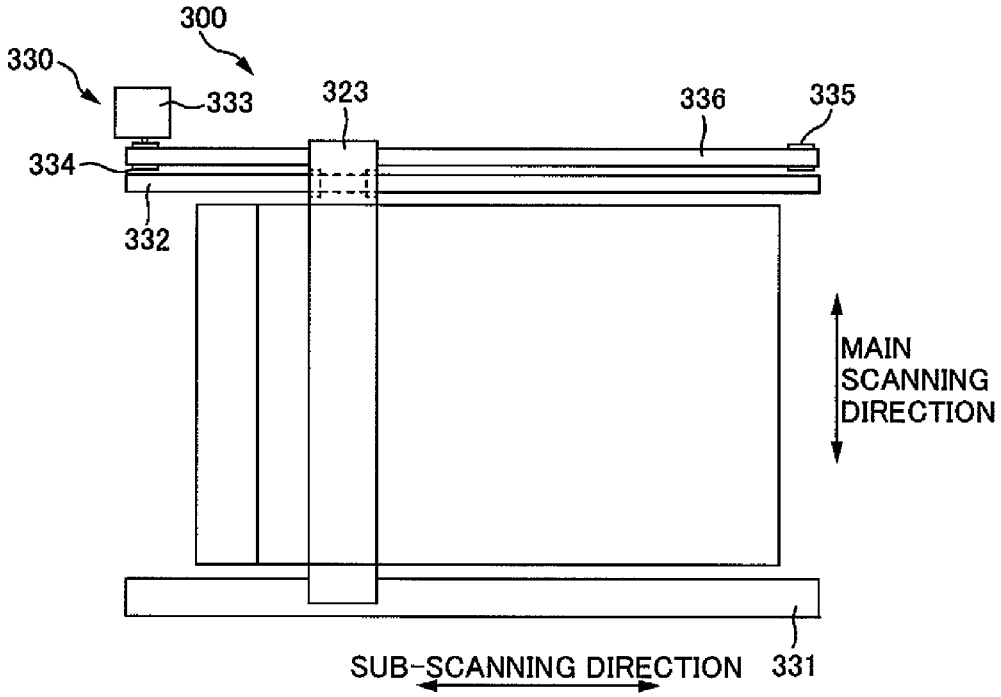
FIG. 12B is a plan view for describing a configuration of the scanner.

As shown in FIGS. 12A and 12B, the reading mechanism 320 includes an original table glass 321, an original table cover 322 and a reading carriage 323. The reading carriage 323 faces a targeted surface for reading of a manuscript (the paper S on which the test pattern CP has been printed) through the original table glass 321 and moves in a predetermined direction along the original table glass 321. In the reading carriage 323, the density of the image is measured by a CCD image sensor 324. The CCD image sensor 324 has a plurality of CCDs arranged corresponding to the reading width along a direction intersecting a movement direction of the reading carriage 323 (an orthogonal direction in this embodiment).

Then, a light from an exposure lamp 325 is irradiated onto the manuscript and the reflected light is guided by a plurality of mirrors 326. These are focused by a lens 327 and inputted onto the CCDs. In this way, it is possible to obtain density data that indicates the density of the image. In short, image density is measured.

The movement mechanism 330 is for moving the reading carriage 323. The movement mechanism 330 includes a support rail 331, a regulating rail 332, a drive motor 333, a drive pulley 334, an idler pulley 335, and a timing belt 336. The support rail 331 supports the reading carriage 323 in a movable state. The regulating rail 332 regulates the movement direction of the reading carriage 323. The drive pulley 334 is attached to a rotation shaft of the drive motor 333. The idler pulley 335 is arranged at an end portion on an opposite side from the drive pulley 334. The timing belt 336 is stretched around the drive pulley 334 and the idler pulley 335, and a portion thereof is fixed to the reading carriage 323.

In the thus-configured scanner 300, the reading carriage 323 is moved along the original table glass 321 (that is, a reading surface of the manuscript) and voltages outputted from the CCD image sensor 324 are obtained at a predetermined cycle. In this manner, density can be measured in regard to a portion of the manuscript of a distance in which the reading carriage 323 has moved during a single cycle.

Process-Purpose Host Computer 200'

The process-purpose host computer 200' is configured similarly to the host computer 200 of the printing system 10. Accordingly, same reference numerals are assigned to same components and description thereof is omitted. A major difference between the process-purpose host computer 200' and the host computer 200 is in the there-installed computer programs. That is, a process-purpose program is installed as an application program in the process-purpose host computer 200'. The process-purpose program causes the process-purpose host computer 200' to achieve, for example, a function for printing the test pattern CP in the printer 100 targeted for setting correction values, a function for obtaining measurement values of density in the test pattern CP by controlling the scanner 300, and a function for setting correction values for each row region from the density measurement values.

Also installed on the process-purpose host computer 200' are a printer driver for controlling the printer 100 and a scanner driver for controlling the scanner 300. Furthermore, as shown in FIG. 13, one region of the memory 212 of the process-purpose host computer 200' is used as a data table for storing density data (measurement values). Also, the process-purpose host computer 200' causes the obtained correction values to be stored in the correction value storage section 155 of the targeted printer 100.

And as shown in FIG. 14, the correction value storage section 155 is provided with a region for storing the front end process area correction values, a region for storing the normal process area correction values, and a region for storing the rear end process area correction values. Also, in addition to the correction value storage section 155, provided in the memory 152 of the printer 100 are a region for storing the number of row regions of the front end process area (front end process segment and front end-side coexistent segment), a region for storing the number of row regions of the normal process area, and a region for storing the number for row regions of the rear end process area (rear end process segment and rear end-side coexistent segment).

Processes at Printer Manufacturing Factory

Printing of Test Pattern CP

Next, processes performed by the printer manufacturing factory are explained. It should be noted that the correction value setting process described below is achieved by a computer program installed on the process-purpose host computer 200', that is, a correction value setting program, a scanner driver, and a printer driver. Consequently, these computer programs include code for executing correction value setting processes.

Prior to the processes in which the correction values are set, the operator at the factory connects the printer 100 for which the correction values are to be set to the process-purpose host computer 200'. The correction value setting program installed in the process-purpose host computer 200' causes the CPU 212 to carry out the correction value setting process and other relevant processes. Such processes include, for example, a process for causing the printer 100 to print a test pattern CP, a process for subjecting the density data obtained from the scanner 300 to image processing or analyzing or the like, and a process for storing set correction values on the correction value storage section 155 of the printer 100.

Figure 15A:
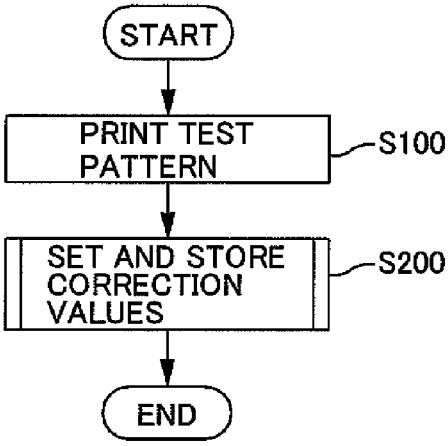
FIG. 15A is a flowchart for describing a correction value setting process that is carried out at a post-manufacturing inspection process of the printer.

After the printer 100 has been connected, a test pattern CP is printed as shown in FIG. 15A (S100). This printing step is carried out by an instruction from the operator. In this printing step, the CPU 212 of the process-purpose host computer 200' generates print data of the test pattern CP. The print data generated by the CPU 212 is sent to the printer 100. Then, the printer 100 prints the test pattern CP on the paper S based on the print data from the process-purpose host computer 200'. This print operation is carried out in accordance with the processes described above (see FIG. 7). Simply described, it is printed by repeating, in accordance with the print data, the dot forming operation (S030) and the transport operation (S040). That is, in the dot forming operation, ink is ejected onto the paper S while the head 131 is moved in the carriage movement direction. Then, in the transport operation, the paper S is transported in the transport direction. At this stage, the correction value storage section 155 is not storing any correction values. Thus, the printed test pattern CP reflects the ejection characteristics of each of the nozzles Nz.

Test Pattern CP

Figure 16:
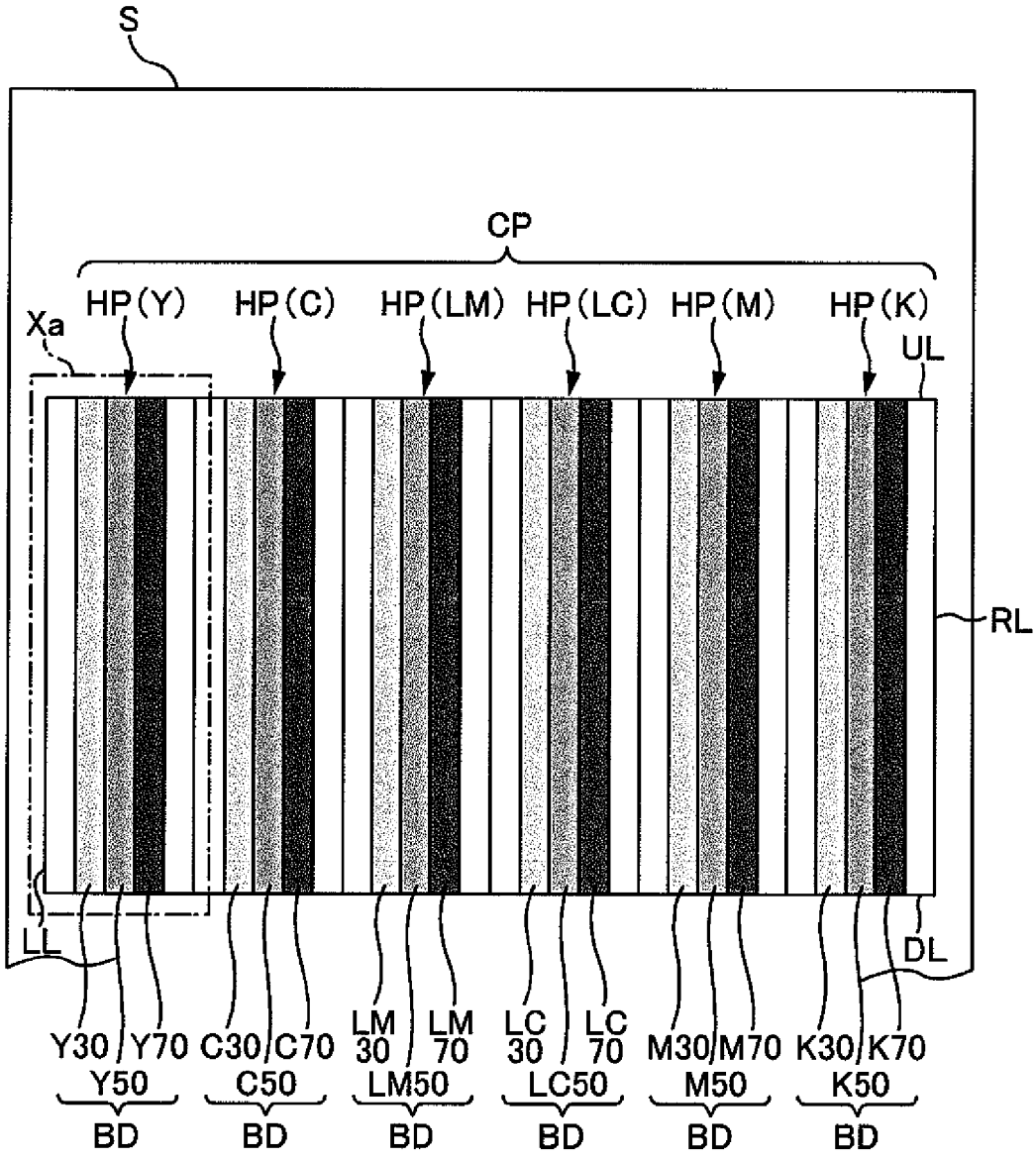
FIG. 16 is an explanatory diagram of a test pattern.

Next, description is given regarding the printed test pattern CP. It should be noted that the test pattern CP is constituted by a plurality of correction patterns HP. A single correction pattern HP is a portion drawn by nozzle rows (nozzle group) that can eject the same type of ink, and corresponds to a sub pattern. The correction pattern HP is used to evaluate variance in the density. As described earlier, the head 131 of the printer 100 has six nozzle rows constituted by a black ink nozzle row Nk, a yellow ink nozzle row Ny, a cyan ink nozzle row Nc, a magenta ink nozzle row Nm, a light cyan ink nozzle row Nlc, and a light magenta ink nozzle row Nlm. Accordingly, as shown in FIG. 16, the test pattern CP has six correction patterns HP(Y) to HP(K) corresponding to these respective nozzle rows. And these correction patterns HP(Y) to HP(K) are arranged (printed) in a state lined up in the carriage movement direction.

Figure 17:
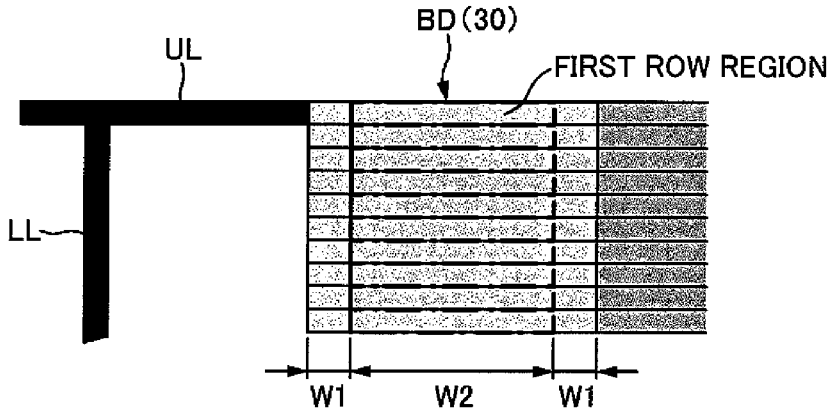
FIG. 17 is an explanatory diagram showing a portion of a correction pattern.

As shown in FIGS. 16 and 17, each of the correction patterns HP(Y) to HP(K) is constituted by plural types of band-like patterns BD, an upper ruled line UL, a lower ruled line DL, a left ruled line LL, and a right ruled line RL. The band-like patterns BD correspond to regions printed in different densities, and has a band shape elongated in the transport direction. The band-like patterns BD of the present embodiment are constituted by three types of patterns, which are printed according to respectively different instruction values for density. Accordingly, the test pattern CP includes a plurality of groups, each made up of plural band-like patterns BD (group of regions) printed according to different instructed tone values, corresponding to the nozzle rows.

For example, the correction pattern (Y) printed using the yellow ink nozzle row Ny includes a band-like pattern BD(Y30) printed at a density of 30%, a band-like pattern BD(Y50) printed at a density of 50%, and a band-like pattern BD(Y70) printed at a density of 70%. For the sake of convenience in the following description, when description is given of the correction patterns HP without specifying the responsible nozzle row, these are referred to simply as correction patterns HP. Similarly, when description is given of the band-like patterns BD without specifying the responsible nozzle row, the band-like pattern BD(30) indicates a density of 30%, the band-like pattern BD(50) indicates a density of 50%, and the band-like pattern BD(70) indicates a density of 70%.

These band-like patterns BD(30) to BD(70) are band-like regions elongated in the transport direction and are arranged in a state lined up in the carriage movement direction. It should be noted that in the present embodiment, a same color ink (hereinafter also referred to as a "process-purpose ink") are ejected from the respective nozzle rows during processing. The process-purpose ink may be colored light magenta for example. Even when the correction patterns HP(Y) to HP(K) to be printed on the paper S are each printed using the same color, non-uniformity in density occurs due to the characteristics of each of the nozzles Nz constituting the nozzle rows. By setting correction values so as to reduce these density non-uniformities, density non-uniformity can be reduced when multicolor printing is to be performed by a user.

Figure 19:
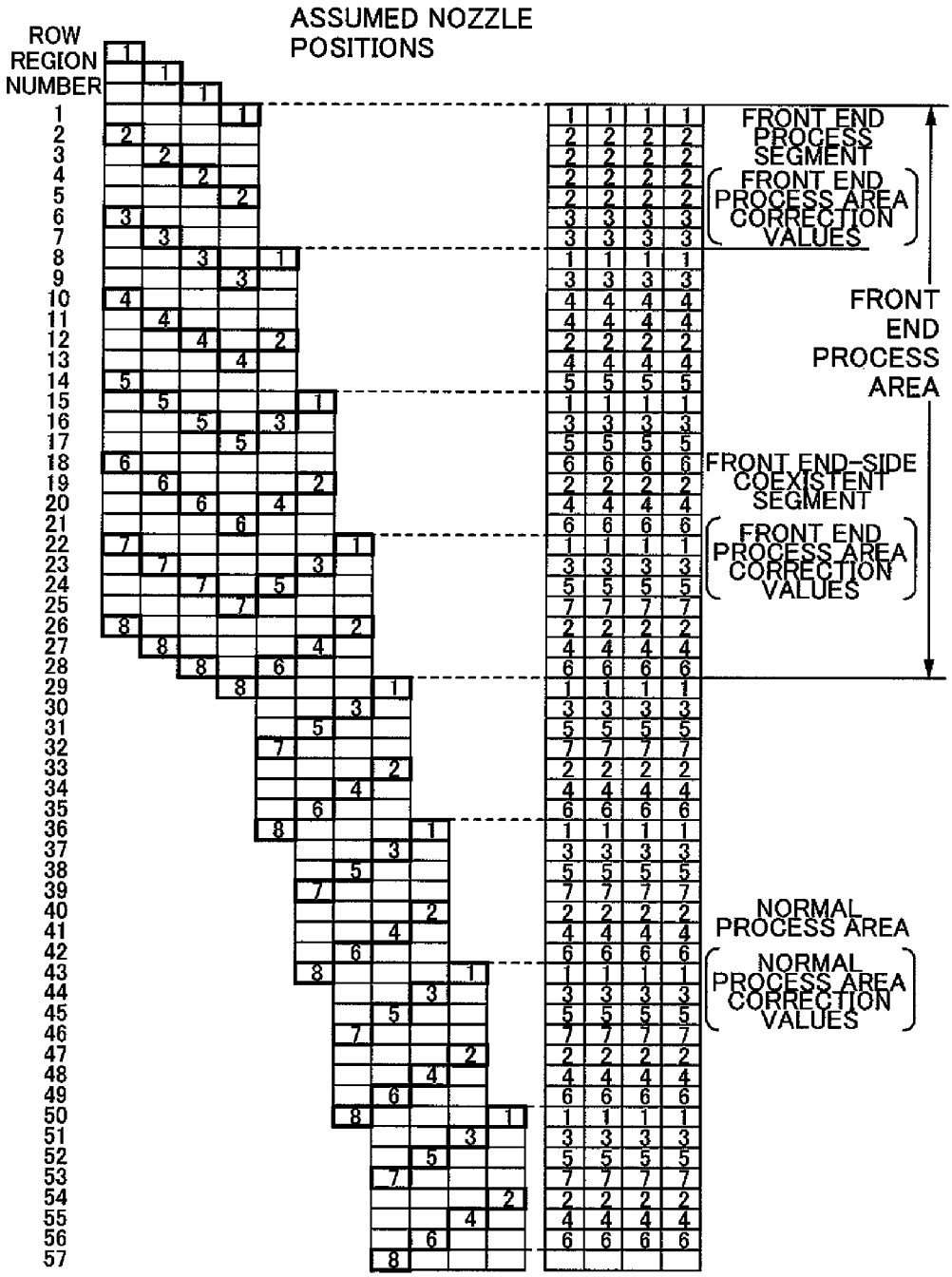
FIG. 19 shows a relationship between correction values of a front end process area and a normal process area for each row region.
Figure 20:
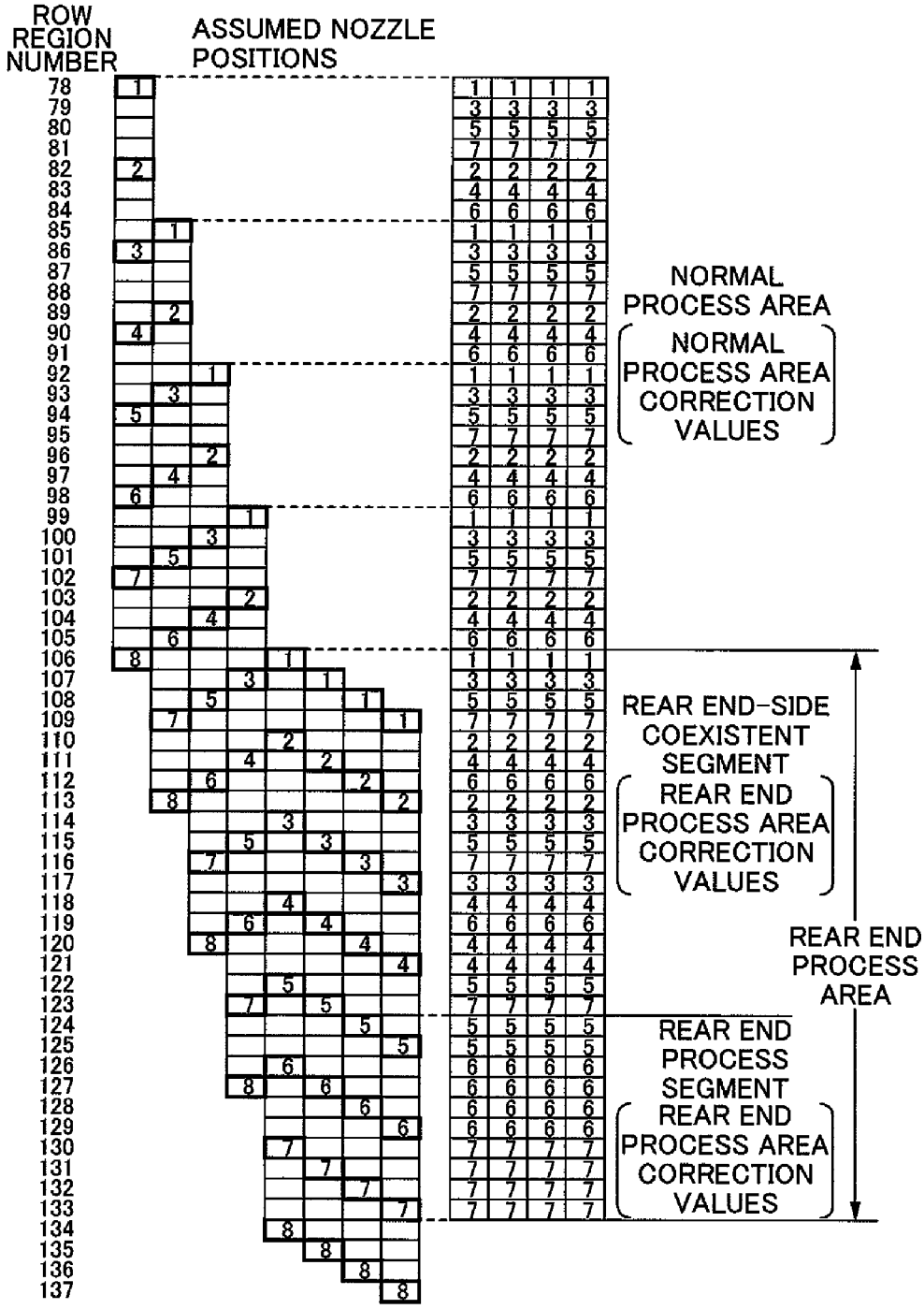
FIG. 20 shows a relationship between correction values of the normal process area and a rear end process area for each row region.

As described above, when an image is printed, the front end process, the normal process, and the rear end process are performed. And each correction pattern HP is also printed using the same procedure as when printing an image, namely, using the front end process, the normal process, and the rear end process. Consequently, the correction patterns HP each include a normal process area (corresponding to a second area) in which patterns are formed using only the normal process, a front end process area printed on a downstream side from the normal process area in the transport direction, and a rear end process area printed on an upstream side from the normal process area in the transport direction. Additionally, as shown in FIG. 19, the front end process area includes a front end process segment (corresponding to a first area on a front end side) constituted by row regions in which raster lines are formed using the front end process, and a front end-side coexistent segment (corresponding to a third area on the front end side) in which row regions in which raster lines are formed using the front end process (corresponding to certain row regions on the front end side) and row regions in which raster lines are formed using the normal process (corresponding to another row regions on the front end side) are mixed. Similarly, as shown in FIG. 20, the rear end process area includes a rear end process segment (corresponding to a first area on a rear end side) constituted by row regions in which raster lines are formed using the rear end process, and a rear end-side coexistent segment (corresponding to a third area on the rear end side) in which row regions in which raster lines are formed using the rear end process (corresponding to certain row regions on the rear end side) and row regions in which raster lines are formed using the normal process (corresponding to another row regions on the rear end side) are mixed.

It should be noted that in image printing performed by the user, the number of row regions that constitute the normal process area is, in case of A4 size for example, approximately several thousands. However, since there is periodicity in the combinations of nozzles Nz responsible for each row region in the normal process area, it is not necessary to print all of these. Consequently, in the present embodiment, the transport direction length of the normal process area in the respective correction patterns HP is set to a length that includes row regions corresponding to a plurality of periods. For example, a length is set corresponding to eight periods.

Furthermore, as shown in FIG. 17, in the correction patterns HP, the upper ruled line UL is formed by the first row region in the band-like pattern BD. Similarly, the lower ruled line DL is formed by the final row region in the band-like pattern BD.

Initial Settings of Scanner 300

Figure 15B:
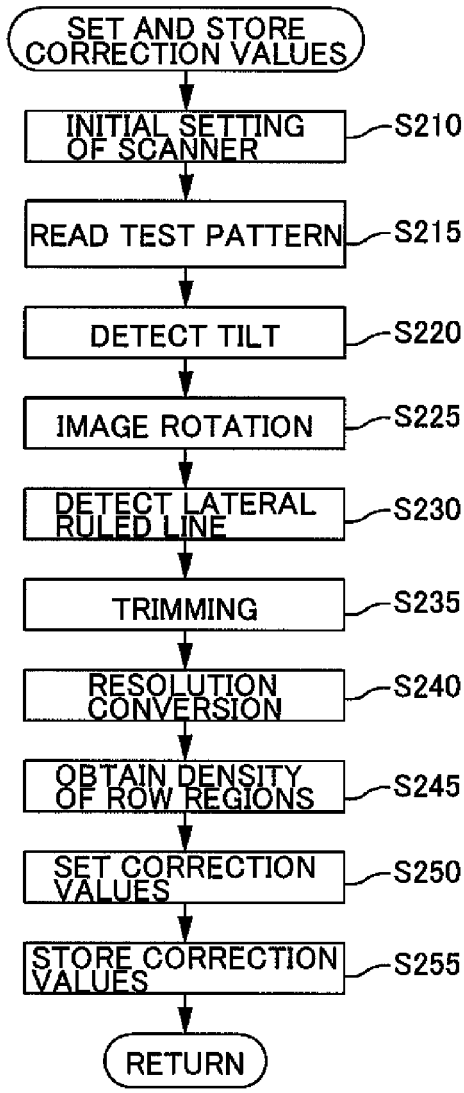
FIG. 15B is a flowchart for describing steps taken for setting and storing correction values in the correction value setting process.

After the test pattern CP is printed, a process for setting correction values and storing them in the printer 100 is carried out (S200). This process is described below. As shown in FIG. 15B, in this process, the initial setting of the scanner 300 is carried out first (S210). In these initial settings, necessary items are set including for example the reading resolution of the scanner 300 and the types of manuscripts. Here, the reading resolution of the scanner 300 is required to be higher than the print resolution. Preferably, the reading resolution is set to an integer multiple of the print resolution. In the present embodiment, since the print resolution of the test pattern CP is 720 dpi, the reading resolution of the scanner 300 is set to 2,880 dpi, four times the print resolution. Furthermore, the types of the document are set to reflection copy, the image type is set to 8-bit grayscale, and the format for saving is set as bitmap.

Reading of Test Pattern CP

After the initial setting of the scanner 300 is finished, the test pattern CP is read (S215). In this step, in the scanner 300, the scanner-side controller 310 controls the reading mechanism 320 and the movement mechanism 330 to obtain density data of the entire paper S. Here, the density data is obtained along a lengthwise direction of the band-like patterns BD. Then, the scanner 300 outputs the obtained density data to the process-purpose host computer 200'. It should be noted that the density data obtained as described above becomes data indicating the density for each pixel (in this case, region in the size determined by the reading resolution), and constitutes an image. For this reason, in the following description, data obtained by the scanner 300 is also referred to as image data. Also, the density data for each of the pixels that constitutes the image data is also referred to as pixel density data. The pixel density data is constituted by tone values indicating density.

Upon receiving image data from the scanner 300, the host-side controller 210 of the process-purpose host computer 200' extracts from the received image data, image data of a predetermined range corresponding to each of the correction patterns HP. The predetermined range is defined as a rectangular range of a size that is slightly larger than the correction pattern HP. In the present embodiment, six sets of image data are extracted corresponding respectively to the six types of correction patterns HP. For example, for the correction pattern HP(Y) drawn by the nozzle row that ejects yellow ink, image data of the range indicated by the reference symbol Xa in FIG. 16 is extracted.

Correction of Tilt in Each Correction Pattern HP

Next, the host-side controller 210 detects a tilt θ of the correction pattern HP in the image data (S220), and performs a rotation process on the image data according to the tilt θ (S225). For example, the host-side controller 210 obtains the image density of the upper ruled line UL in a plurality of locations by shifting positions of the locations in a width direction of the paper S, and detects the tilt θ of the correction pattern HP based on these image densities. Then a rotation process is carried out on the image data based on the detected tilt.

Trimming of Correction Pattern HP

The host-side controller 210 then detects lateral ruled lines (upper ruled line UL and lower ruled line DL) from the image data of the respective correction patterns HP (S230), and performs trimming (S235). First, the host-side controller 210 obtains the pixel density data for pixels in the predetermined range from the image data that has been subjected to the rotation process. Then the host-side controller 210 identifies the upper ruled line UL based on the image density and performs trimming to discard portions above the upper ruled line UL. Similarly, the host-side controller 210 identifies the lower ruled line DL based on the image density and performs trimming to discard portions below the lower ruled line DL.

Resolution Conversion

After trimming, the host-side controller 210 converts the resolution of the image data that has been subjected to trimming (S240). In this process, the resolution of the image data is converted so that the number of pixels in the Y-axis direction in the image data (which is the transport direction and the direction in which the row regions are arranged) is equal to the number of raster lines constituting the correction pattern HP. For example, it is assumed that the correction pattern HP printed at the resolution 720 dpi is read at a resolution of 2,880 dpi. In this case, in an ideal state, the number of pixels in the Y-axis direction in the image data is four times the number of raster lines constituting the correction pattern HP. However, actually, there are cases in which the number of the raster lines does not match the number of pixels due to various effects such as error in printing or reading. Resolution conversion is carried out on the image data in order to solve such a mismatch. In the resolution conversion process, a magnification for conversion is calculated based on a ratio of the number of raster lines constituting the correction pattern HP to the number of pixels in the Y-axis direction in the trimmed image data. Then, the resolution conversion process is performed using the calculated magnification. Various methods such as a bicubic method can be used in resolution conversion. As a result, the number of pixels lined up in the Y-axis direction becomes equal to the number of row regions, and pixel rows lined up in the X-axis direction and row regions correspond to each other one by one.

Obtaining Density of Each Row Region

Figure 18:
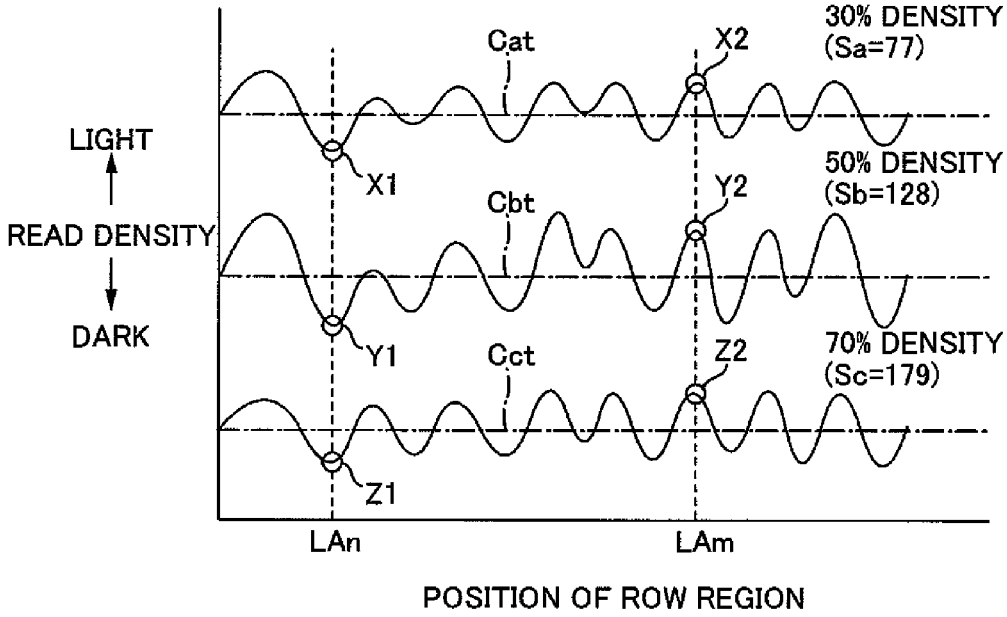
FIG. 18 shows measurement values of band-like patterns for each row region.

Next, the host-side controller 210 obtains the density of each row region in the correction pattern HP (S245). In obtaining the density of each row region, the host-side controller 210 obtains a centroid position of a vertical ruled line (in this case, the left ruled line LL) that serves as a reference, and specifies pixels that constitute each band-like pattern BD using the centroid position of the ruled lines as the reference. Then, pixel density data is obtained for the specified pixels. For example, for the band-like pattern BD(30) printed at a density of 30%, the pixel density data is obtained for each pixel pertaining to a central scope W2 excluding end portions indicated by the reference symbols W1 as shown in FIG. 17. Then, an average value obtained from each of the obtained pixel density data is used as a measurement value of 30% density for the first row region. Measurement values are similarly obtained for the second row region and other band-like patterns BD. The measurement values correspond to the values of density measured by the scanner 300. Then the obtained measurement values are stored in the data table (see FIG. 13) of the memory 212 of the host-side controller 210. That is, the measurement values are stored in an area specified by the type of nozzle row, the print density of the pattern, and the row region number. It should be noted that the densities 1 through 3 in FIG. 13 signify densities of the respective band-like patterns BD. For example, density 1 corresponds to 30% density, density 2 corresponds to 50% density, and density 3 corresponds to 70% density. Then, when these are plotted with the measurement values stored in the data table determined as the vertical axis and the position of the row regions determined as the horizontal axis, a graph as shown in FIG. 18 for example is obtained.

Setting of Correction Values

After the measurement values of each of the row regions are obtained, the host-side controller 210 sets correction values for each of the row regions (S250). As mentioned earlier, one band-like pattern BD is printed at an identical instructed tone value. However, the obtained measurement values (density measurement values) of the respective row regions vary. This variance causes density non-uniformity in printed images. In order to eliminate the density non-uniformity, it is required to make the measurement values of each of the row regions of the respective band-like patterns BD be uniform as much as possible. From this point of view, the correction values are set for each of the row regions based on the measurement values of each of the row regions. As described earlier, the test pattern CP includes a plurality of the correction patterns HP(Y) to HP(K) printed by each type of nozzle row, and each of the correction patterns HP(Y) to HP(K) includes band-like patterns BD printed in different predetermined densities. Further, the respective band-like patterns BD(30) to BD(70) have a plurality of row regions. That is, a plurality of row regions are determined in the band-like pattern BD (a region printed at the predetermined density), lined up in the transport direction. Therefore, the correction values are set for each of different colors, for each of different densities, and for each row region.

As shown in FIGS. 19 and 20, the printer 100 corrects the ink ejection amount for each row region pertaining to the normal process area (corresponding to the second area) based on the normal process area correction values (corresponding to second correction values). Then it corrects the ink ejection amount for each row region pertaining to the front end process segment of the front end process area (corresponding to the first area on the front end side) based on the front end process area correction values (corresponding to first correction values on the front end side). Also, it corrects the ink ejection amount for each row region pertaining to the front end-side coexistent segment of the front end process area (corresponding to the third area on the front end side) based on the front end process area correction values (corresponding to third correction values on the front end side). Similarly it corrects the ink ejection amount for each row region pertaining to the rear end process segment of the rear end process area (corresponding to the first area on the rear end side) based on the rear end process area correction values (corresponding to first correction values on the rear end side), and also corrects the ink ejection amount for each row region pertaining to the rear end-side coexistent segment of the rear end process area (corresponding to the third area on the rear end side) based on the rear end process area correction values (corresponding to third correction values on the rear end side). Accordingly, the correction value setting system 20 sets the front end process area correction values, the normal process area correction values, and the rear end process area correction values, and stores these in the printer 100. Hereinafter, description is given concerning the setting of these correction values.

Setting of Front End Process Area Correction Values

First, description is given concerning the setting of the front end process area correction values. As mentioned earlier, the front end process area correction values are correction values applied to each row region constituting the front end process area. As shown in FIG. 19, the front end process area has the front end process segment and the front end-side coexistent segment. Here, the front end process segment is constituted by a plurality of row regions in which raster lines are formed by the front end process. In the example of FIG. 19, row regions number 1 through number 7 pertain to the front end process segment. Furthermore, in the front end-side coexistent segment, row regions in which raster lines are formed by the front end process (certain row regions on the front end side) and row regions in which raster lines are formed by the normal process (another row regions on the front end side) coexist. In the example of FIG. 19, row regions number 8 through number 28 pertain to the front end-side coexistent segment. In the front end-side coexistent segment, the row regions in which raster lines are formed by the front end process are the row regions of number 9 through number 11, number 13, number 14, number 17, number 18, number 21, and number 25. And in the row regions of other numbers, raster lines are formed by the normal process.

Figure 21:
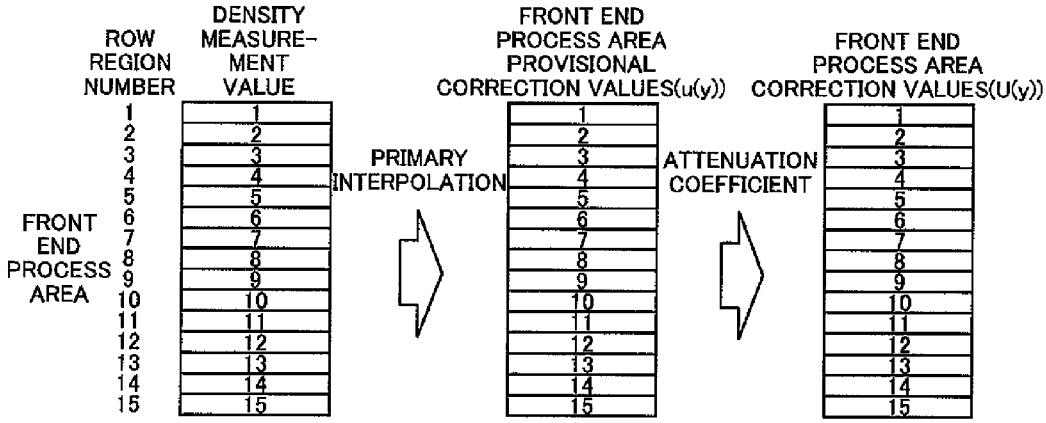
FIG. 21 is a conceptual diagram for describing a process of setting front end process area correction values.

As shown in the outline in FIG. 21, the front end process area correction values are obtained based on values in which provisional correction values based on density measurement values (front end process area provisional correction values) are multiplied by the attenuation coefficient. And these are set separately for each row region constituting the front end process area (the front end process segment and the front end-side coexistent segment). Here, the attenuation coefficient is used in order to match the extent of correction according to the front end process area correction values to the extent of correction according to the normal process area correction values. As is described later, in the normal process area correction values, types are set corresponding to combinations of the row regions and the responsible nozzles Nz. As shown in the outline in FIG. 22, in the test pattern CP (in each of the correction patterns HP), patterns are printed for a plurality of periods, and provisional correction values are obtained based on the density measurement values for the respective row regions. And correction values of types corresponding to combinations of nozzles Nz are set by averaging the plurality of provisional correction values corresponding to the same nozzles Nz. For this reason, the normal process area correction values have excellent accuracy from which reading error and the like of the scanner 300 is removed. In contrast to this, the provisional correction values (that is, the front end process area provisional correction values) obtained based on the density measurement values are influenced by reading error and the like of the scanner 300. For this reason, when the provisional correction values are used as the correction values and applied as they are to the row regions pertaining to the front end process area, the variance in the extent of correction becomes excessively greater than the variance in the extent of correction according to the normal process area correction values. Accordingly, in the present embodiment, the front end process area correction values are set by multiplying the front end process area provisional correction values, which are obtained based on the density measurement values, by the attenuation coefficient.

In relation to a specific example of a process of setting the front end process area correction values, description is given concerning an instructed tone value Sb (50% density) in row regions LAn and Lam shown in FIG. 18. First, the host-side controller 210 obtains provisional correction values based on the density measurement values for the respective row regions pertaining to the front end process area. In this case, target densities are determined for the density for which provisional correction values are to be set. In this example, average values of the measurement values (read densities) in each row region are set as the target density for the band-like patterns BD of the densities for which provisional correction values are to be set. That is, the density indicated by the reference symbol Cbt is set as the target density. Then, provisional correction values of the targeted row region are set in response to a difference from the measurement values. By setting the provisional correction values of each row region in this manner, the respective provisional correction values are more suitable. This is because the image densities in each of the row regions are made uniform to an average density as the target density. The same is true for other densities also in relation to this point. That is, at 30% density, the density indicated by the reference symbol Cat is set as the target density, and at 70% density the density indicated by the reference symbol Cct is set as the target density.

Next, the host-side controller 210 selects the measurement values of lower side density that are lower than the density for which provisional correction values are to be set and the measurement values of higher side density that are higher than that density. In the present embodiment, the setting target of the provisional correction values is 50% density (instructed tone value Sb), and therefore the measurement values of the row regions that constitute the band-like pattern BD of 30% density (instructed tone value Sa) are selected as the lower side density. Similarly, the measurement values of the row regions that constitute the band-like pattern BD of 70% density (instructed tone value Sc) are selected as the higher side density. It should be noted that the row regions selected as lower side density or higher side density are in the same position as the row regions of the setting target. For example, when the provisional correction value is to be set for the row region LAn, a measurement value of the row region LAn having 30% density and a measurement value of the row region LAn having 70% density are selected.

Once the measurement values of the lower side density and the higher side density are selected, the host-side controller 210 specifies a group of measurement values to be referenced in response to a magnitude relationship of the measurement value corresponding to row regions of 50% density, which is the setting target of the provisional correction value, and the target density Cbt. Here, a group of measurement values to be referenced is specified so that the target density falls under a scope between the measurement value of the row region as the setting target and the measurement value of other densities. That is, when the measurement value of the target row region is higher than the target density, the group of the measurement value of the target row region and the measurement value of the lower side density is prescribed as a group of the measurement values to be referenced. Conversely, when the measurement value of the target row region is lower than the target density, the group of measurement value of the target row region and the measurement value of the higher side density is prescribed as a group of the measurement values to be referenced.

For example, in the row region LAn, a measurement result of the row region in 30% density is X1, a measurement result of the row region in 50% density is Y1, and a measurement result of the row region in 70% density is Z1. Here, the measurement result Y1 of 50% density is plotted on a lower side than the target density Cbt in the graph. The vertical axis in the graph shows lower densities on the upper side and higher densities on the lower side. Accordingly, the measurement result Y1 of the row region LAn of 50% density is higher than the target density Cbt. For this reason, the host-side controller 210 specifies the measurement value corresponding to the row region of 50% density and the measurement value corresponding to the row region of 30% density as the group of measurement values to be referenced. Furthermore, in the row region LAm, a measurement result of the row region in 30% density is X2, a measurement result of the row region in 50% density is Y2, and a measurement result of the row region in 70% density is Z2. In this case, the density of the row region LAm of 50% density is lower than the target density Cbt. For this reason, the host-side controller 210 specifies the measurement value corresponding to the row region of 50% density and the measurement value corresponding to the row region of 70% density as the group of measurement values to be referenced.

Once the group of measurement values to be referenced has been specified, the host-side controller 210 sets the provisional correction values (the front end process area provisional correction values) of the targeted row region. The settings of the provisional correction values are performed using primary interpolation based on the measurement values and the instructed tone values. The host-side controller 210 carries out primary interpolation computations for the respective row regions for which correction values are to be set. Then, provisional correction values for the instructed tone values Sb (50% density) are set respectively.

Provisional correction values are set using the same procedure for row regions of other densities, namely, the row regions of 30% density and 70% density. It should be noted that the point that the densities to be referenced are fixed for 30% density and 70% density is different from the case of 50% density. That is, in the case of 30% density, the measurement value of the 30% density row region and the measurement value of the 50% density row regions are referenced. Furthermore, in the case of 70% density, the measurement value of the 70% density row region and the measurement value of the 50% density row regions are referenced. And the point of setting the provisional correction values using primary interpolation based on the measurement values and the instructed tone values is the same as in the case of 50% density. Furthermore, the provisional correction values in the present embodiment are set in a range from a value [1] to a value [256]. Here, a value [128] signifies "no correction". Also, with the provisional correction values, values greater than the value [128] signify higher densities, and values smaller than the value [128] signify lower densities. In regard to this point, the same is true for the other provisional correction values and the correction values.

Once the provisional correction values have been set, the host-side controller 210 obtains correction values from the obtained provisional correction values. In this case, the host-side controller 210 carries out a calculation of a following expression (1) and sets the front end process area correction values for each row region.

$$u(y)=(U(y)-128)\times G/100+128 \quad (1)$$

u(y): front end process area correction value corresponding to number y row region U(y): front end process area provisional correction value corresponding to number y row region y: number of row region for which correction values are to be set G: attenuation coefficient (%)

As is evident from the expression (1), the front end process area correction values are calculated based on values in which the front end process area provisional correction values are multiplied by the attenuation coefficient. And the attenuation coefficient in the present embodiment is determined equally for the row regions of the front end process segment and the row regions of the front end-side coexistent segment, which is 70% for both. That is, the attenuation coefficient for the front end process segment and the attenuation coefficient for the front end-side coexistent segment are equivalent. Furthermore, the range of row regions to which the attenuation coefficient is applied is assigned to the host-side controller 210 as a parameter. In the example of FIG. 19, the value [28] is assigned as the parameter. In this way, the row regions from number [1] to number [28] are determined as the range for setting the front end process area correction values. The range to which the attenuation coefficient is applied can be varied by determining the value of the parameter as appropriate.

Setting of Normal Process Area Correction Values

Next, description is given concerning the setting of the normal process area correction values. As mentioned earlier, the normal process area correction values are correction values applied to each row region constituting the normal process area. The normal process area corresponds to the middle area of the medium in the transport direction. A predetermined number of the normal process area correction values are set based on combinations of the row regions and the nozzles. When described using the example in FIG. 19, in the normal process area, seven types of combinations of row regions and the nozzles Nz are determined. These seven types of combinations occur periodically. Specifically, in the first row region, a dot row is formed by ink ejected from the first nozzle Nz(#1), and in the second row region, a dot row is formed by ink ejected from the third nozzle Nz(#3). Furthermore, in the third row region, a dot row is formed by ink ejected from the fifth nozzle Nz(#5), and in the fourth row region, a dot row is formed by ink ejected from the seventh nozzle Nz(#7). Similarly, in the fifth row region, a dot row is formed by ink ejected from the second nozzle Nz(#2), in the sixth row region, a dot row is formed by ink ejected from the fourth nozzle Nz(#4), and in the seventh row region, a dot row is formed by ink ejected from the sixth nozzle Nz(#6). Consequently, in this example, it can be said that it is sufficient if seven types of the normal process area correction values are set corresponding to these row regions.

Figure 22:
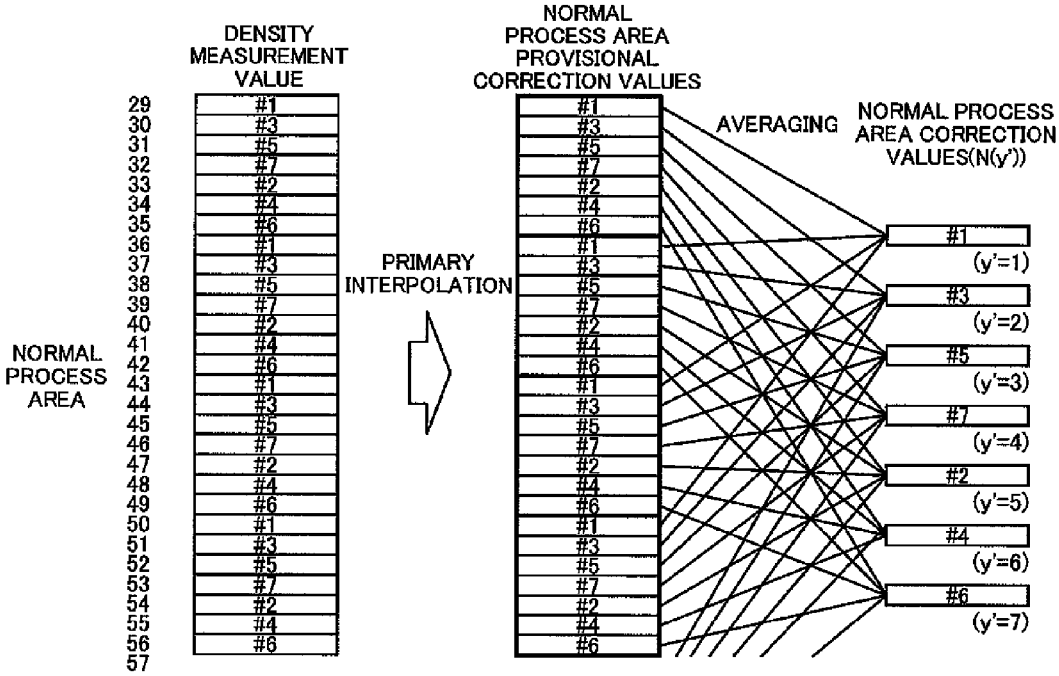
FIG. 22 is a conceptual diagram for describing a process of setting normal process area correction values.

As shown in the outline of FIG. 22, in setting of the normal process area correction values, the host-side controller 210 obtains provisional correction values (normal process area provisional correction values) for each row region. And normal process area correction values are set based on values in which a plurality of the provisional correction values corresponding to the same nozzles Nz are averaged. In this case, in order to obtain the provisional correction values, the host-side controller 210 defines a target density for the density for which provisional correction values are to be set. That is, an average value of measurement values of the row regions is set as the target density. Next, the host-side controller 210 sets the provisional correction values for each row region for the normal process area of the test pattern CP. The method for setting the provisional correction values is the same method as described for the front end process correction values. Described simply, the host-side controller 210 selects the measurement values of lower side density that are lower than the density for which provisional correction values are to be set and the measurement values of higher side density that are higher than that density. Then, it specifies the groups of measurement values to be referenced and sets the provisional correction values by performing primary interpolation using the specified groups. Next, the host-side controller 210 averages the provisional correction values of each period and sets the normal process area correction values. As mentioned earlier, eight periods of row regions are contained in one band-like pattern BD. Thus, the host-side controller 210 obtains provisional correction values for a first row region of each of the first period to the eighth period, and sets the averaged value as the correction value of the first row region (a row region of y'=1). Similarly, it obtains the provisional correction values of a second row region of each period, and sets the averaged value as the correction value of the second row region (a row region of y'=2). When described using the example of FIG. 22, the row region number 29, the row region number 36, the row region number 43, the row region number 50 and so on are selected as the first row regions corresponding to the nozzle Nz(#1). And the correction value of the first row region is obtained by averaging the provisional correction values of these respective row regions. Similarly, the row region number 30, the row region number 37, the row region number 44, the row region number 51 and so on are selected as the second row regions corresponding to the nozzle Nz(#3). And the correction value of the second row region is obtained by averaging the provisional correction values of these respective row regions. The same process is carried out also for the other row regions to obtain correction values for the respective row regions. As a result, as is shown on the right side area of FIG. 22, normal process area correction values of types ((row regions of y'=1 to 7)) that are determined by combinations of nozzles Nz are set for each row region.

Setting of Rear End Process Area Correction Values

Next, description is given concerning the setting of the rear end process area correction values. As mentioned earlier, the rear end process area correction values are correction values applied to each row region constituting the rear end process area. As shown in FIG. 20, the rear end process area has the rear end process segment and the rear end-side coexistent segment. Here, the rear end process segment is constituted by a plurality of row regions in which raster lines are formed by the rear end process. In the example of FIG. 20, row regions number 124 through number 133 pertain to the rear end process segment. Furthermore, in the rear end-side coexistent segment, row regions in which raster lines are formed by the rear end process (certain row regions on the rear end side) and row regions in which raster lines are formed by the normal process (another row regions on the rear end side) are mixed together. In the example of FIG. 20, row regions number 106 through number 123 pertain to the rear end-side coexistent segment. In the rear end-side coexistent segment, the row regions in which raster lines are formed by the rear end process are the row regions of number 106, number 110, number 113, number 114, number 117, number 118, and numbers 120 through number 122. And in the row regions of other numbers, raster lines are formed by the normal process.

Figure 23:
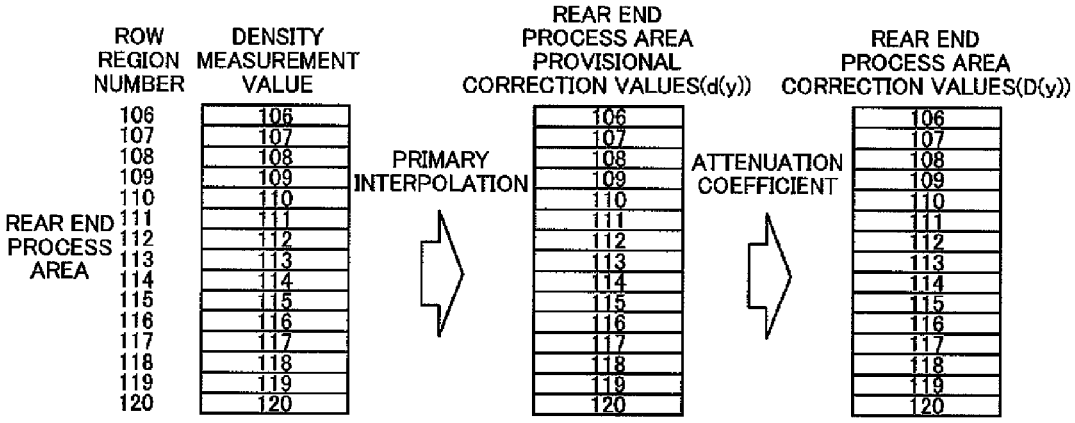
FIG. 23 is a conceptual diagram for describing a process of setting rear end process area correction values.

As shown in the outline in FIG. 23, the rear end process area correction values are obtained based on values in which provisional correction values based on density measurement values (rear end process area provisional correction values) are multiplied by the attenuation coefficient. And these are set separately for each row region constituting the rear end process area (the rear end process segment and the rear end-side coexistent segment). Here, the attenuation coefficient is used in order to match the extent of correction according to the rear end process area correction values to the extent of correction according to the normal process area correction values. In regard to this point, it is the same as the attenuation coefficient described for the front end process area correction values. Consequently, in the present embodiment, the rear end process area correction values are set by multiplying the rear end process area provisional correction values, which are obtained based on the density measurement values, by the attenuation coefficient. It should be noted that the setting of the rear end process area correction values is performed using a procedure according to settings of the front end process area correction values based on a following expression (2). Furthermore, the attenuation coefficient is 70%, the same as that used in setting of the front end process area correction values. For this reason, description thereof is omitted.

$$d(y)=(D(y)-128)\times G/100+128 \quad (2)$$

d(y): rear end process area correction value corresponding to number y row region D(y): rear end process area provisional correction value corresponding to number y row region y: number of row region for which correction values are to be set G: attenuation coefficient (%)

Regarding Attenuation Coefficient

Figure 24A:
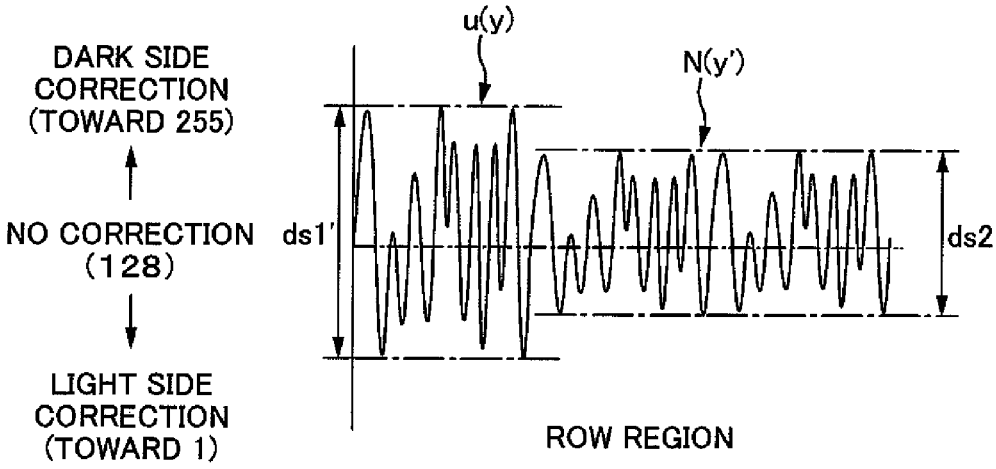
FIG. 24A is a conceptual diagram for describing an extent of variance between front end process area provisional correction values and the normal process area correction values.

Here, description is given regarding the attenuation coefficient. As described earlier, the attenuation coefficient is used in order to match the extent of correction according to the front end process area correction values or the rear end process area correction values to the extent of correction according to the normal process area correction values. For example, the normal process area correction values indicated by the reference symbol N(y') in FIGS. 24A, 24B, 25A, and 25B are obtained as average values of a plurality of provisional correction values. For this reason, they are obtained as highly accurate values from which error and the like has been removed. Thus, variance in the normal process area correction values falls under a range indicated by the reference symbol ds2. On the other hand, the front end process area provisional correction values indicated by the reference symbol u(y) in FIG. 24A are obtained directly from the density measurement values of the test pattern CP. Thus, a variance indicated by the reference symbol ds1' is greater compared to the variance ds2 of the normal process area correction values. When printing is performed by applying these front end process area provisional correction values as they are, undesirably differences in density occur with the normal process areas due to the differences in the extent of this variance.

Figure 24B:
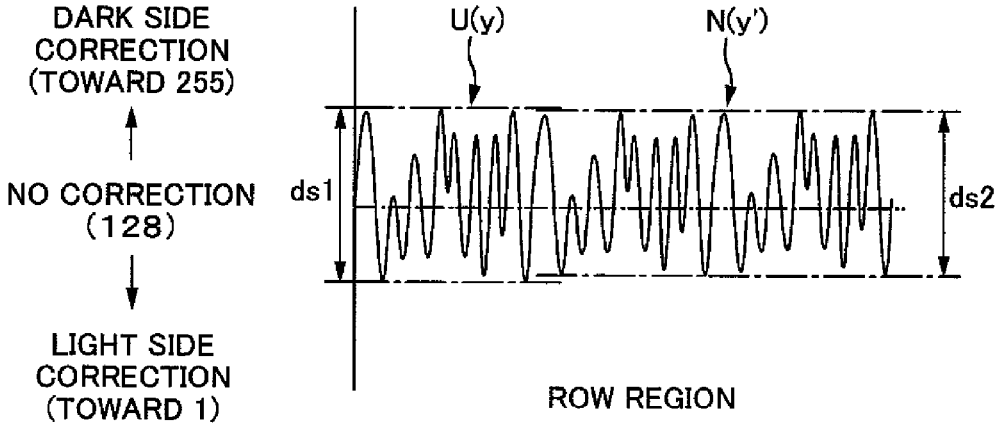
FIG. 24B is a conceptual diagram for describing an extent of variance between the front end process area correction values and the normal process area correction values.

And the front end process area correction values indicated by the reference symbol U(y) in FIG. 24B are obtained by multiplying the front end process area provisional correction values by the attenuation coefficient. Thus, a variance indicated by the reference symbol ds1 is substantially equivalent in magnitude to the variance ds2 of the normal process area correction values. For this reason, differences in density with the normal process area can be ameliorated by applying the front end process area correction values to print the front end process area.

Figure 25A:
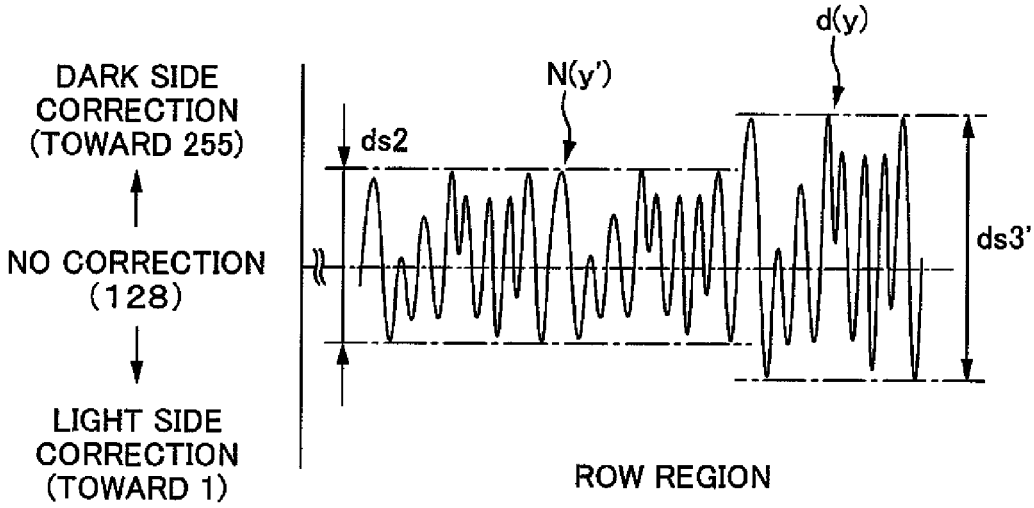
FIG. 25A is a conceptual diagram for describing an extent of variance between the rear end process area provisional correction values and the normal process area correction values.
Figure 25B:
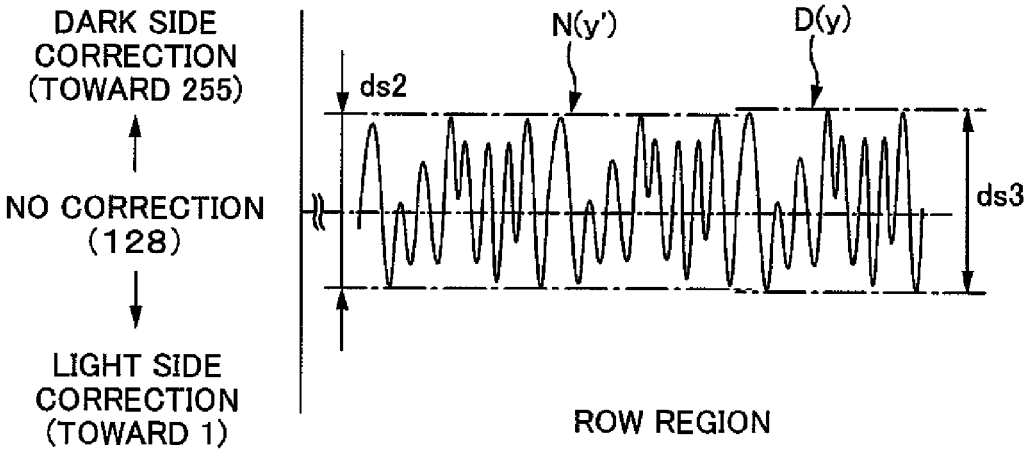
FIG. 25B is a conceptual diagram for describing an extent of variance between the rear end process area correction values and the normal process area correction values.

Furthermore, the same is true for the rear end process area correction values. That is, the variance of the rear end process area provisional correction values indicated by the reference symbol d(y) in FIG. 25A is of a magnitude indicated by the reference symbol ds3'. The variance ds3' is greater than the variance ds2 of the normal process area correction values. And the rear end process area correction values indicated by the reference symbol D(y) in FIG. 25B are obtained by multiplying the rear end process area provisional correction values by the attenuation coefficient, and therefore the variance indicated by the reference symbol ds3 is substantially equivalent in magnitude to the variance ds2 of the normal process area correction values. For this reason, differences in density with the normal process area can be ameliorated by applying the rear end process area correction values to print the rear end process area.

With the attenuation coefficient defined in this manner, the extent of correction of the front end process area correction values can be made uniform to the extent of correction of the normal process area correction values. Furthermore, the extent of correction of the rear end process area correction values also can be made uniform to the extent of correction of the normal process area correction values. In other words, it is possible to make the extents of correction appropriate.

Storage of Correction Values

Once correction values are set, the host-side controller 210 stores the set correction values in the memory 152 of the printer-side controller 150 (the correction value storage section 155, see FIG. 14) (S255). In this case, the host-side controller 210 communicates with the printer 100, thereby assuring a state in which correction values can be stored. And the host-side controller 210 transfers the correction values stored in the memory 212 of the host-side controller 210 so that the correction values are stored in the memory 152 of the printer-side controller 150. In this correction value setting system 20, the correction values set based on the measurement values of the band-like patterns BD(30) to BD(70), namely the front end process area correction values, the normal process area correction values, and the rear end process area correction values are stored.

Printing by Users

Following the procedure described above, the printer 100, in which the correction values are stored in the correction value storage section 155, undergoes other inspections and is shipped from the factory. A user who has purchased the printer 100 connects the printer 100 to a host computer 200 of the user, as shown in FIG. 1 for example. Then, once powered on, the printer 100 waits for print data to be sent from the host computer 200. When print data is sent from the host computer 200, a printing operation is carried out. The printing operation carried out here is as described earlier. That is, the host computer 200 references the correction values in the color conversion process, then corrects the density of the image (instructed tone values) in the row regions using the corresponding correction values. For example, with respect to a row region that tends to be recognized dark, the tone values of pixel data (CMYK data) in unit regions corresponding to that row region are corrected so as to become lower. Conversely, with respect to a row region that tends to be recognized light, the tone values of the pixel data in unit regions corresponding to that row region are corrected so as to become higher. Then, the host computer 200 carries out halftone processes and the like with the corrected image density and obtains print data. The print data generated in this manner is outputted to the printer 100. Then the printer 100 adjusts the ink ejection amount based on this print data. As a consequence of this, in the printed images of the printer 100, the density of image pieces corresponding to each of the row regions is corrected, and thus density non-uniformities in the entire image are suppressed.

At this time, as described earlier, by using the attenuation coefficient, the extent of correction of the front end process area correction values can be made uniform to the extent of correction of the normal process area correction values, and the extent of correction of the rear end process area correction values can be made uniform to the extent of correction of the normal process area correction values. As a result, it is possible to make the extent of correction appropriate and to suppress image quality deterioration at the borders of the end areas (the front end process area and the rear end process area) and the middle area (the normal process area). Furthermore, depending on how the attenuation coefficient is applied, the extents of correction using the front end process area correction values and the rear end process area correction values can be adjusted. Moreover, since, in regard to the respective front end-side coexistent segment and the rear end-side coexistent segment, correction is carried out using the front end process area correction values and the rear end process area correction values, image quality deterioration in these areas can be suppressed. In this case, since the same-value attenuation coefficient is used for the front end process segment and the front end-side coexistent segment, or the rear end process segment and the rear end-side coexistent segment, it is possible to make the extent of corrections appropriate.

Second Embodiment

In the foregoing first embodiment, correction values of one period are set for the normal process area, and correction values are set for the front end process area and the rear end process area by attenuating the provisional correction values that are based on density measurement values. In this manner, since the setting methods are different, when the correction values of the front end process area, the correction values of the rear end process area and the correction values of the normal process area are used as they were, the extent of density correction is different between the areas corrected using the correction values for the front end process area and the correction values for the rear end process area and the areas corrected using the correction values for the normal process area, such that there is a possibility in which undesirable differences in density occur at border areas.

Accordingly, in the printing system 10, the front end process area correction values and the rear end process area correction values (corresponding to the first correction values) that are used in the front end process and the rear end process (corresponding to the first print mode applied to the end area of the medium in the transport direction) and that are for correcting the ink ejection amounts of each row region are set on a row region basis; and the normal process area correction values (corresponding to the second correction values) that are used in the normal process (corresponding to the second print mode applied to the middle area of the medium in the transport direction) and that are for correcting the ink ejection amounts of each row region are set on a row region basis. And when printing to the paper S, for the coexistent segments in which are mixed the certain row regions, in which the raster lines are formed using the front end process or the rear end process, and the other row regions, in which the raster lines are formed using the normal process, the host computer 200 corrects the ink ejection amounts for each of the row regions using combined correction values that are obtained as a composition of the front end process area correction values or the rear end process area correction values and the normal process area correction values. By employing this configuration, the corrections of ink ejection amounts are performed according to the combined correction values in the coexistent segments, thereby ameliorating differences in the extents of correction according to the correction values. As a result, image quality deterioration caused by differences in the correction values can be prevented. As a result, image quality can be improved. Hereinafter, this is described in detail. It should be noted that in describing the second embodiment, configurations that are the same as the first embodiment have same reference symbols and description thereof is omitted. Furthermore, in regard to the procedure of setting of the correction values, the same procedure is applied up to the setting of the front end process area correction values, the normal process area correction values, and the rear end process area correction values. For this reason, description concerning same portions is omitted and description is given concerning portions that are different.

Regarding Correction Value Storage Section

Figure 26:
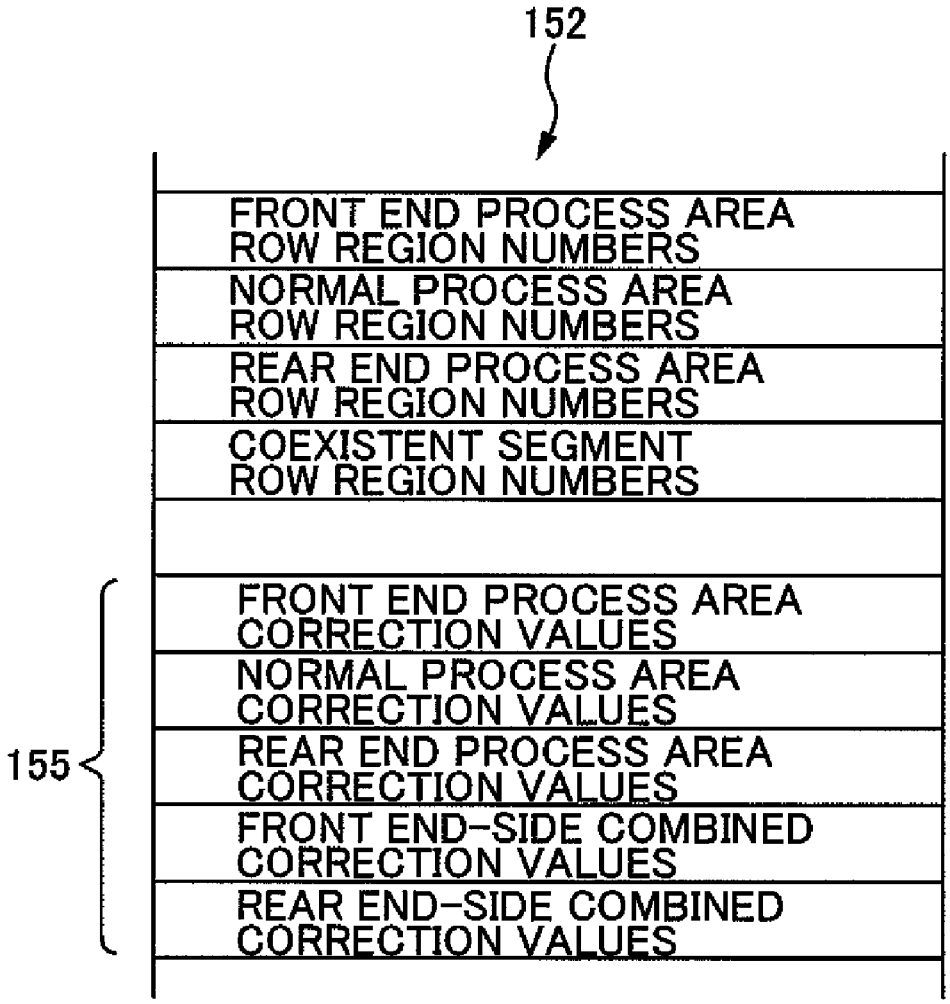
FIG. 26 is a conceptual diagram of a printer memory and a correction value storage section in the second embodiment.
Figure 27:
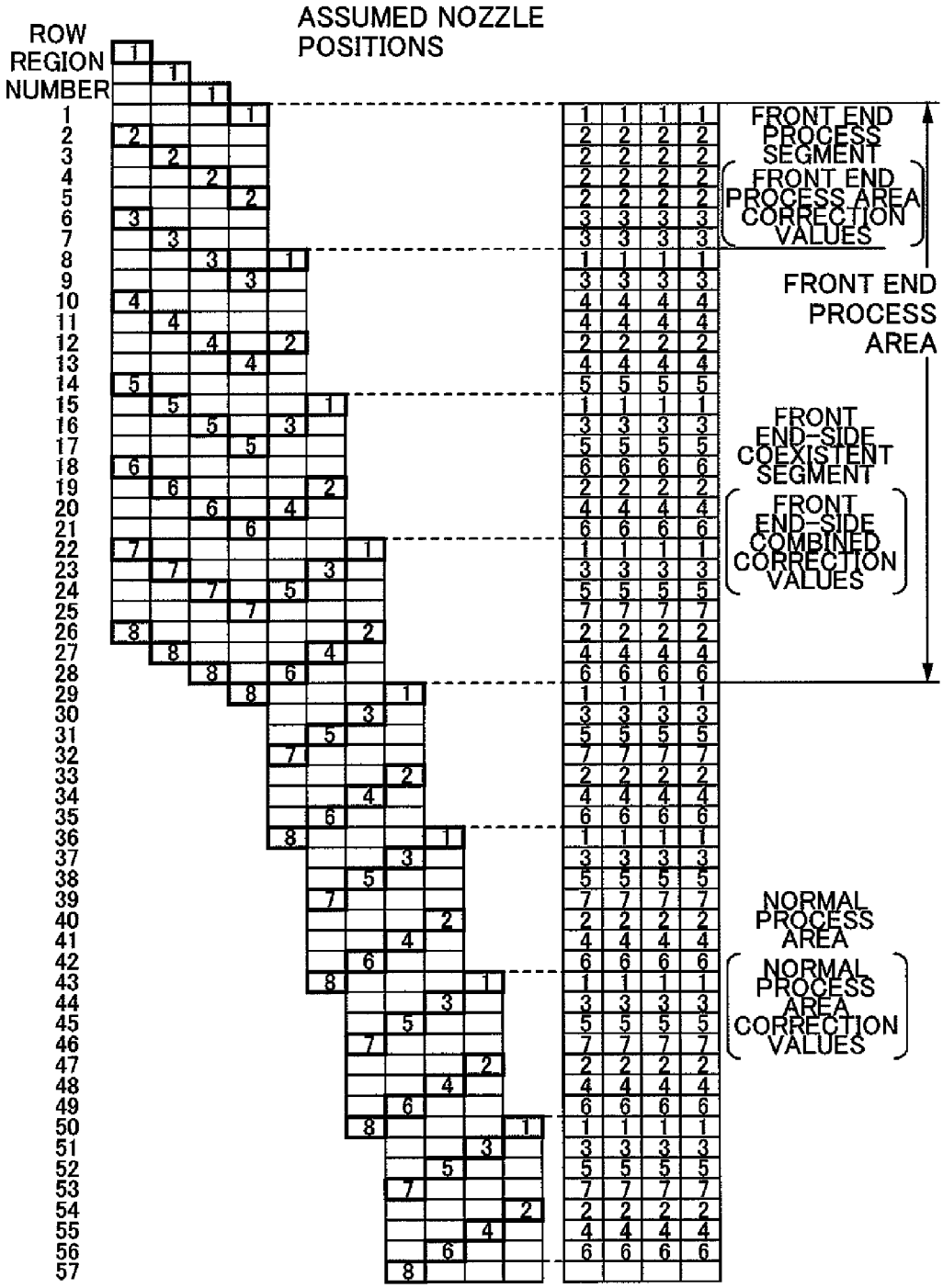
FIG. 27 shows a relationship between correction values of a front end process area and a normal process area for each row regions in the second embodiment.
Figure 28:
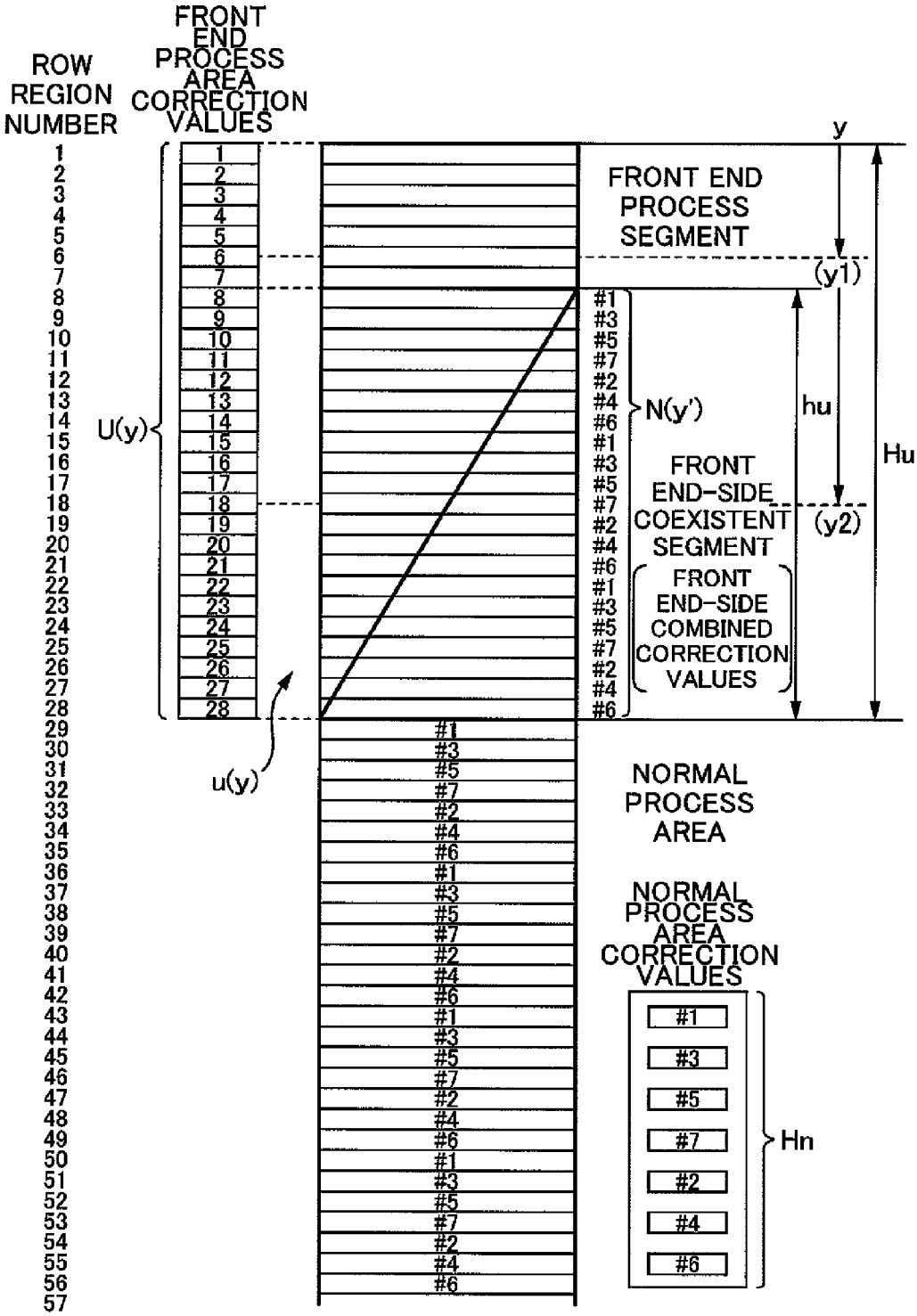
FIG. 28 is a conceptual diagram for describing a process of setting front end-side coexistent segment correction values in the second embodiment.

As shown in FIG. 26, in the second embodiment, in the correction value storage section 155 are provided a region for storing front end-side combined correction values and a region for storing rear end-side combined correction values. As shown in FIG. 27, the front end-side combined correction values are correction values that are applied to each row region pertaining to the front end-side coexistent segment, and are set as a composition of the front end process area correction values and the normal process area correction values. As shown in FIG. 28, the rear end-side combined correction values are correction values that are applied to each row region pertaining to the rear end-side coexistent segment, and are set as a composition of the rear end process area correction values and the normal process area correction values.

Setting of Front End-Side Combined Correction Values

Next, description is given concerning the setting of the front end-side combined correction values. In the example of FIG. 27, row regions of the front end-side coexistent segment in which raster lines are formed by the front end process are the row regions of number 9 through number 11, number 13, number 14, number 17, number 18, number 21, and number 25. And in the row regions of other numbers, raster lines are formed by the normal process. Here, focusing on the row regions in which the raster lines are formed by the front end process, a ratio thereof increases as closer to, and decreases as further from, the front end process segment. For example, in the row regions from number 8 to number 16 pertaining to a first half portion of the front end-side coexistent segment, five row regions of the nine row regions are those in which raster lines formed by the front end process. In contrast to this, in the row regions from number 20 to number 28 pertaining to a second half portion of the front end-side coexistent segment, two row regions of the nine row regions are those in which raster lines formed by the front end process. From this it can be said the front end-side coexistent segment is a segment defined on the front end side from the middle area of the paper S in the transport direction, and is a segment in which a ratio of regions in which raster lines are formed by the normal process increases the greater the closeness to the normal process area.

And the composition proportions of the front end process area correction values and the normal process area correction values in the front end-side combined correction values are determined based on the position in the front end-side coexistent segment of the row region for which correction values are to be set. For example, as shown in FIG. 28, when comparing the combined correction values for row regions positioned on a close side to the normal process area and the combined correction values for row regions positioned on a far side from the normal process area, the proportion of normal process area correction values in the former (the close side) is increased above the proportion of normal process area correction values in the latter (the far side). And the proportion of the normal process area correction values is increased for row regions closer to the normal process area.

A reason for setting this in this manner is due to the fact that a ratio of row regions in which raster lines are formed by the normal process in the front end-side coexistent segment increases the greater the closeness to the normal process area. By defining the composition proportion in this manner, the composition proportion of the front end process area correction values to the normal process area correction values can be made in accordance with the proportion of the row regions in which the raster lines are formed by the front end process to the row regions in which the raster lines are formed by the normal process. That is, the composition proportion of both sets of correction values can be defined in accordance with the ratio of both row regions. As a result, it is possible to make the front end-side combined correction values appropriate, and appropriate correction can be achieved. Hereinafter, description is given concerning a specific procedure.

Specific Procedure of Settings

The front end-side combined correction values are set by the host-side controller 210 of the process-purpose host computer 200'. Thus, in performing the settings, the following parameters are assigned to host-side controller 210. As shown in FIG. 28, the number Hu of row regions pertaining to the front end process area, (the number of) types Hn of the normal process correction values, the number hu of the row regions that constitute the front end-side coexistent segment, and a number y of the row region for which correction values are to be set are set as calculation parameters. Also, when number y of the row region is defined, a front end process area correction value U(y) and a normal process area correction value N(y') corresponding to that number y are specified. Then, when number y of a row region for which correction values are to be set is assigned, the host-side controller 210 carries out calculations of the following expressions (3) through (5) to obtain the front end-side combined correction value u(y) corresponding to the row region. That is, a composite ratio is calculated for each row region and the front end-side combined correction value u(y) is obtained.

When $y < Hu - hu$ $$u(y) = U(y) \tag{3}$$

When $y \geq Hu - hu$ $$u(y) = \left[\frac{y - (Hu - hu)}{hu} \times (N(y') - 128) + \frac{Hu - y}{hu} \times (U(y) - 128)\right] + 128 \tag{4}$$

$$y' = ((y + Hn) - (Hu \bmod Hn) + 1) \bmod Hn) + 1 \tag{5}$$

As is evident from the expression (3), when a number y row region pertains to the front end process segment (when y<Hu−hu), the front end process area correction value U(y) corresponding to that row region is used as it is. It should be noted that in expression (3), the front end-side combined correction values u(y) are determined so as to be equivalent to the front end process area correction values U(y). This is in order to make the setting process common for when a number y row region pertains to the front end process segment and when it pertains to the front end-side coexistent segment. As is evident from the expression (4), when the number y row region pertains to the front end-side coexistent segment (when y≧Hu−hu), a ratio is used of the number hu of row regions in the front end process segment to the numbers Hu−y and y−(Hu−hu) of the row regions in the front end process segment specified by the number y. Then, the front end process area correction values U(y) and the normal process area correction values N(y') are composed proportionally according to the obtained ratios. It should be noted that a predetermined number of the normal process area correction values are prepared, the predetermined number being defined by combinations of the row regions and the responsible nozzles Nz as described earlier. For this reason, the number y cannot be used as it is. Accordingly, as shown in the expression (5), a number y' of a correction value corresponding to the number y is obtained. Then, the corresponding normal process area correction values N(y') are used in calculations. It should be noted that in expression (5), mod signifies residue modulo. For example, Hu mod Hn signifies the remainder of Hu÷Hn.

Here, detailed description of this calculation is given based on the specific example of FIG. 28. In this example, the number Hu of row regions pertaining to the front end process area is a value [28], the type Hn of the normal process correction values is a value [7], the number hu of row regions constituting the front end-side coexistent segment is a value [21], and number y of a row region for which correction values are to be set is a variable from a value [1] through a value [28]. First, description is given concerning a case of a number y1 of a row region (value [6]). In the case of this example, a value [7] is obtained when the number hu of row regions constituting the front end-side coexistent segment is subtracted from the number Hu of row regions pertaining to the front end process area. And since the row region number y1 is a value [6], a condition of y<Hu−hu is satisfied. Accordingly, the front end process area correction value corresponding to the number y1 row region (namely the front end process area correction value U(6) set in the sixth row region) is used as the correction value for that row region. Next, description is given concerning a case of a number y2 (18) of a row region. In the case of this example, since the row region number y2 is a value [18], a condition of y≧Hu−hu is satisfied. And the number y2' for specifying the normal process area correction value becomes (((18+7)−(0+1))mod [7])+1. That is, it becomes ([24] mod [7])+1 and becomes a value [4]. For this reason, the host-side controller 210 specifies the correction value of the nozzle Nz(#7), which is a normal process area correction value for the fourth row region, as the normal process area correction value N(y2'). Furthermore, based on the number y2 (value [18]), the correction value corresponding to the eighteenth row region is specified as the front end process area correction value U(y2). After specifying the normal process area correction value N(y2') and the front end process area correction value U(y2) corresponding to the number y2, the host-side controller 210 obtains the corresponding front end-side combined correction value u(y2). In this case, the host-side controller 210 carries out a calculation of (18−(28−21))/21 and obtains a coefficient to be used in the normal process area correction values. This coefficient becomes a value [11/21]. Similarly, the host-side controller 210 carries out a calculation of (28−18))/21 and obtains a coefficient to be used in the front end process area correction values. This coefficient becomes a value [10/21]. Further still, the host-side controller 210 subtracts the value [128], which signifies no correction, from the normal process area correction value N(y2') and multiplies the subtracted value by the coefficient (value [11/21]). Similarly it subtracts the value [128], which signifies no correction, from the front end process area correction value U(y2) and multiplies the subtracted value by the coefficient (value [11/21]). Thereafter, the front end-side combined correction values u(y2) are obtained by adding together the values obtained by multiplication by the coefficient and further adding the value [128] signifying no correction. In this example, the coefficient used in the normal process area correction values is the value [11/21] and the coefficient used in the front end process area correction values is the value [10/21], and therefore a ratio of the normal process area correction values N(y2') to the front end process area correction values U(y2) in the front end-side combined correction values u(y2) is substantially one to one.

It should be noted that the ratio of the normal process area correction values N(y') to the front end process area correction values U(y) in the front end-side combined correction values u(y) changes in response to the row region number y. Generally, as shown schematically in FIG. 28, it can be said that the ratio of normal process area correction values N(y') becomes larger than front end process area correction values U(y) as the row region number y indicates a row region which is closer to the normal process area, and that the ratio of normal process area correction values N(y') becomes smaller than front end process area correction values U(y) as the row region number y indicates a row region which is farther from the normal process area.

Setting of Rear End-Side Combined Correction Values

Figure 29:
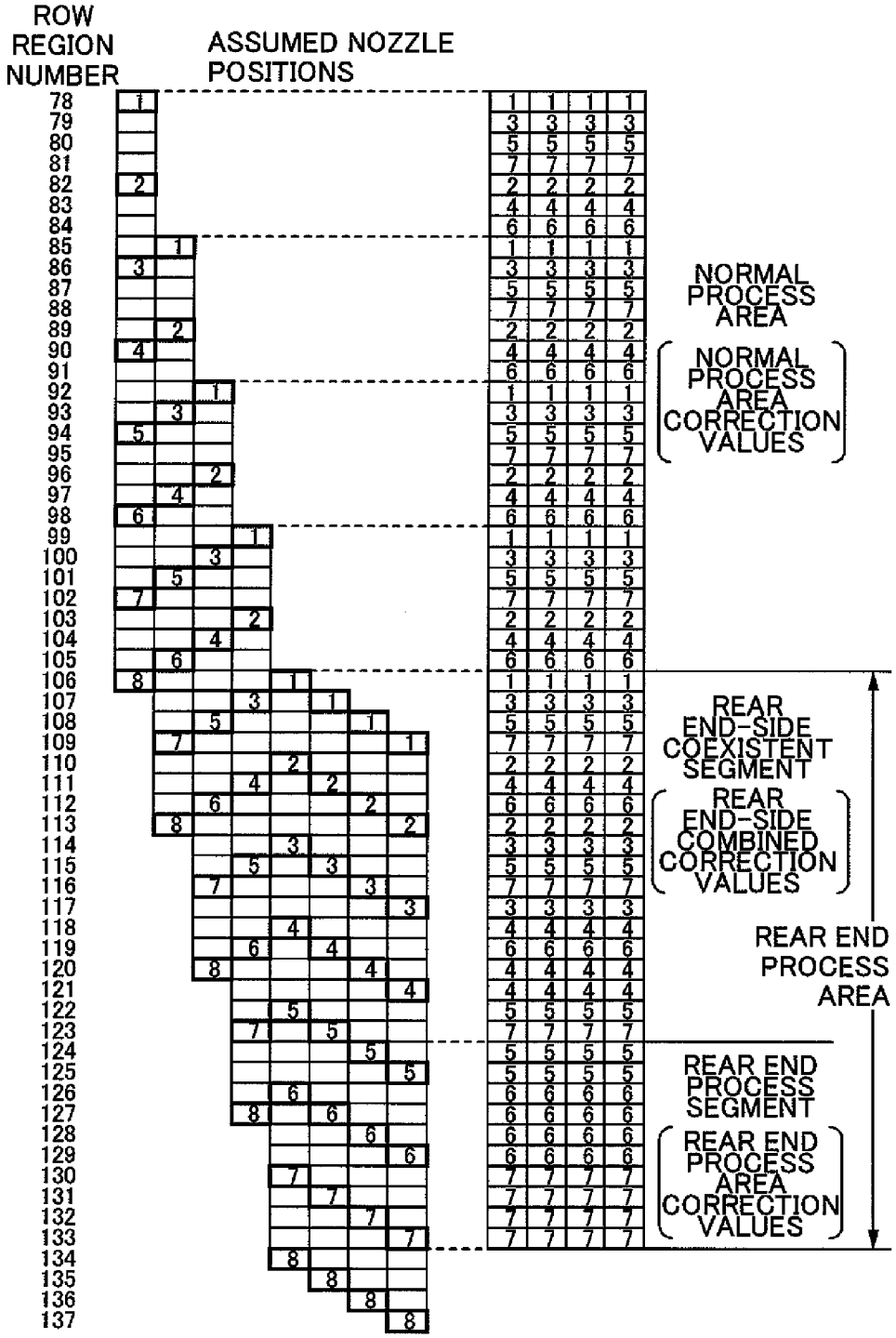
FIG. 29 shows a relationship between correction values of the normal process area and a rear end process area for each row regions in the second embodiment.

Next, description is given concerning the setting of the rear end-side combined correction values. The rear end-side combined correction values are applied to the rear end-side coexistent segment in the rear end process area. In the example of FIG. 29, row regions number 106 through number 123 pertain to the rear end-side coexistent segment. In the rear end-side coexistent segment, row regions in which raster lines are formed by the rear end process are the row regions of number 106, number 110, number 113, number 114, number 117, number 118, and number 120 through number 122. And in the row regions of other numbers, raster lines are formed by the normal process. Here, focusing on the row regions in which the raster lines are formed by the rear end process, a ratio thereof increases as closer to, and decreases as further from, the rear end process segment. Conversely, for the row regions in which the raster lines are formed by the normal process, a ratio thereof increases as closer to, and decreases as farther from, the normal process area. From this it can be said the rear end-side coexistent segment is a segment defined on the rear end side from the middle area of the paper S in the transport direction, and is a segment in which a ratio of regions in which raster lines are formed by the normal process decreases the greater the distance from the normal process area.

Figure 30:
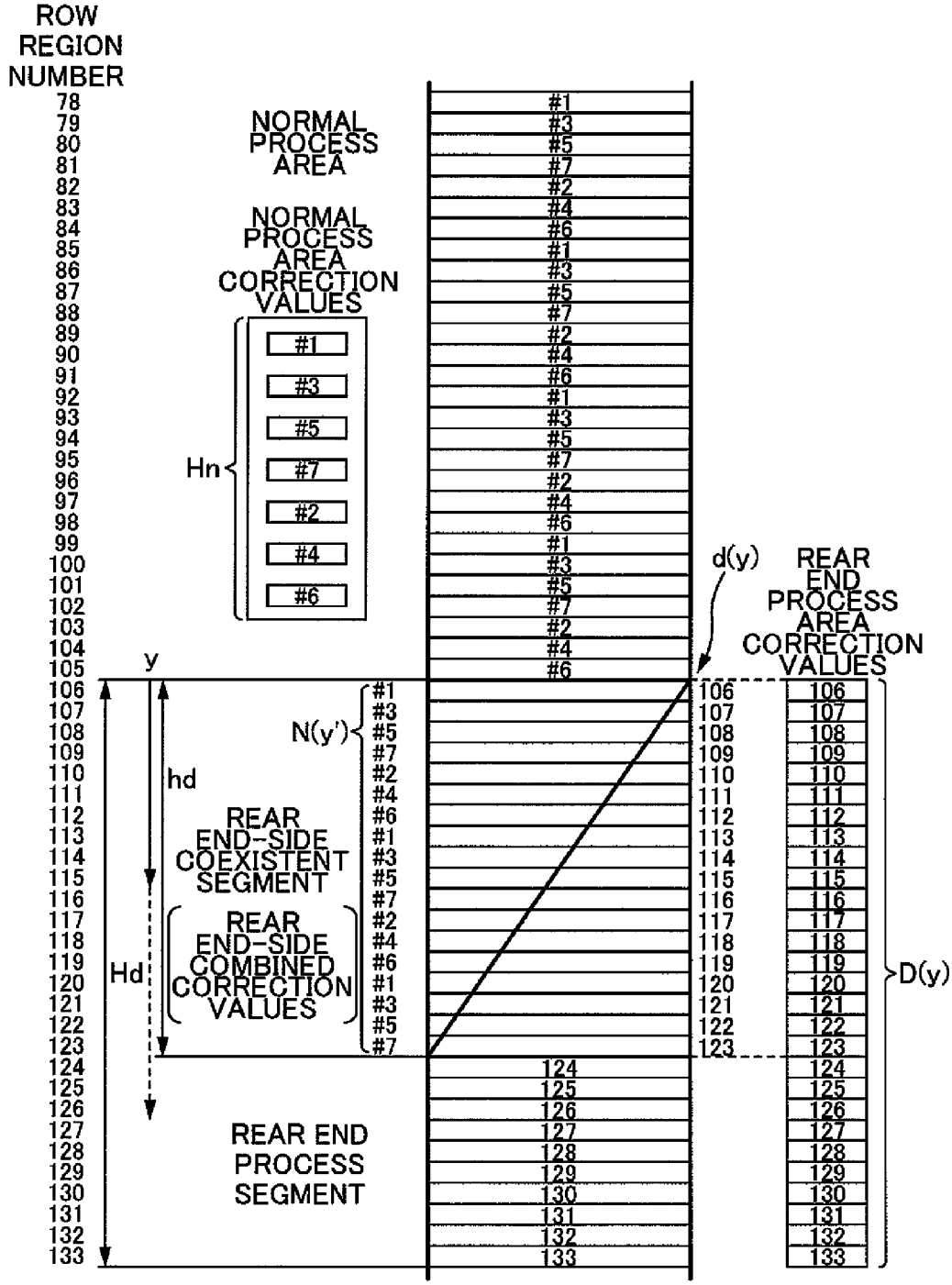
FIG. 30 is a conceptual diagram for describing a process of setting rear end-side coexistent segment correction values in the second embodiment.

And the composition proportions of the rear end process area correction values and the normal process area correction values in the rear end-side combined correction values are determined based on the position in the rear end-side coexistent segment of the row region for which correction values are to be set. For example, as shown in FIG. 30, when comparing the combined correction values for row regions positioned on a close side to the normal process area and the combined correction values for row regions positioned on a far side from the normal process area, the proportion of normal process area correction values in the former (the close side) is increased above the proportion of normal process area correction values in the latter (the far side). And the proportion of the normal process area correction values is increased for row regions closer to the normal process area.

A reason for setting this in this manner is due to the fact that the ratio of row regions in which raster lines are formed by the normal process in the rear end-side coexistent segment increases the greater the closeness to the normal process area. By defining the composition proportion in this manner, the composition proportion of the normal process area correction values to the rear end process area correction values can be made in accordance with the proportion of the row regions in which the raster lines are formed by the normal process to the row regions in which the raster lines are formed by the rear end process. That is, the composition proportion of both sets of correction values can be defined in accordance with the ratio of both row regions. As a result, it is possible to make the rear end-side combined correction values appropriate, and appropriate correction can be achieved.

Setting Procedure

Similarly to the front end-side combined correction values, the rear end-side combined correction values are also set by the host-side controller 210 of the process-purpose host computer 200'. Thus, in performing the settings, the following parameters are assigned to the host-side controller 210. As shown in FIG. 30, the number Hd of row regions pertaining to the rear end process area, (the number of) types Hn of the normal process correction values, the number hd of the row regions that constitute the rear end-side coexistent segment, and a number y of the row region for which correction values are to be set are set as calculation parameters. Also, when number y of row regions is defined, a rear end process area correction value D(y) and a normal process area correction value N(y') corresponding to that number y are specified. Then, when number y of a row region for which correction values are to be set is assigned, the host-side controller 210 carries out calculations of the following expressions (6) through (8) to obtain the rear end-side combined correction value d(y) corresponding to the row region.

When $y > hd$ $$d(y) = D(y) \tag{6}$$

When $y \leq hd$ $$d(y) = \left[\frac{hd - y}{hd} \times (N(y') - 128) + \frac{y}{hd} \times (D(y) - 128)\right] + 128 \tag{7}$$

$$y' = ((y - 1) \bmod Hn) + 1 \tag{8}$$

As is evident from the expression (6), when a number y row region pertains to the rear end process segment (when y>hd), the rear end process area correction value D(y) corresponding to that row region is used as it is. As is evident from the expression (7), when the number y row region pertains to the rear end-side coexistent segment (when y≦hd), a ratio is used of the number hd of row regions in the rear end process segment to the numbers hd−y and y of the row regions in the rear end process segment specified by the number y. That is, the rear end process area correction values D(y) and the normal process area correction values N(y') are composed proportionally according to this ratio. It should be noted in regard to the normal process area correction values that the number y cannot be used as it is. Accordingly, as shown in the expression (8), a number y' of a correction value corresponding to the number y is obtained. This point is the same as described for the front end-side combined correction values u(y). Furthermore, the specific procedure of performing the settings is in accordance with the procedure for the front end-side coexistent segment. Thus, further description concerning the specific procedure is omitted.

Storage of Correction Values

Once correction values are set, the host-side controller 210 stores the set correction values in the memory 152 of the printer-side controller 150 (the correction value storage section 155, see FIG. 26). In the correction value setting system 20 of the second embodiment, the correction values that have been set based on the measurement values of the band-like patterns BD(30) to BD(70), namely the front end process area correction values, the normal process area correction values, the rear end process area correction values, the front end-side combined correction values, and the rear end-side combined correction values are stored in the correction value storage section 155.

Printing by Users

Following the procedure described above, the printer 100, in which the correction values are stored in the correction value storage section 155, undergoes other inspections and is shipped from the factory. When printing is performed by a user who has purchased the printer 100, the ink ejection amounts are corrected based on the correction values. The operation at this stage is as described earlier. That is, the host computer 200 corrects the image density (instructed tone values) of the targeted row regions using the corresponding correction values, thereby obtaining print data. The printer 100 adjusts the ink ejection amounts based on this print data. As a consequence of this, in the printed images of the printer 100, the density of image pieces corresponding to each of the row regions is corrected, and thus density non-uniformities in the entire image are suppressed.

As shown in FIG. 28, in the host computer 200 and the printer 100, the ink ejection amounts are corrected based on the front end process area correction values in the front end process segment. In this manner, the ink ejection amount for each row region pertaining to the front end process segment is optimized, thereby enabling image quality to be improved. And in the front end-side coexistent segment, the ink ejection amount for each row region is corrected using the front end-side combined correction values obtained as a composition of the front end process area correction values and the normal process area correction values. With the front end-side combined correction values, the proportion of normal process area correction values becomes larger than the proportion of the front end process area correction values for row regions closer to the normal process area. Here, the ratio of the row regions in which the raster lines are formed by the normal process in the front end-side coexistent segment is greater for closer distances to the normal process area. For this reason, it is possible to make correction using the front end-side combined correction values appropriate. Further still, the proportion of the normal process area correction values to the front end process area correction values in the front end-side combined correction values changes gradually in response to the position of the row region that is targeted. Thus, abrupt variation in the extent of correction can be prevented when switching from the front end process area correction values to the normal process area correction values. As a result, abrupt density variation can be prevented and image quality can be improved.

Furthermore, as shown in FIG. 30, with the host computer 200 and the printer 100, in the rear end-side coexistent segment, the ink ejection amount for each row region is corrected using the rear end-side combined correction values obtained as a composition of the normal process area correction values and the rear end process area correction values. With the rear end-side combined correction values, the proportion of normal process area correction values becomes larger than the proportion of the front end process area correction values for row regions closer to the normal process area. Here, the ratio of the row regions in which the raster lines are formed by the normal process in the rear end-side coexistent segment is greater for closer distances to the normal process area. For this reason, it is possible to make correction using the rear end-side combined correction values appropriate. Further still, the proportion of the normal process area correction values to the rear end process area correction values in the rear end-side combined correction values changes gradually in response to the position of the row region that is targeted. Thus, abrupt variation in the extent of correction can be prevented when switching from the normal process area correction values to the rear end process area correction values. As a result, abrupt density variation can be prevented and image quality can be improved.

It should be noted that in the rear end process segment, the point of achieving improved image quality by correcting the ink ejection amounts is the same as for the front end process segment.

Other Embodiments

In the foregoing embodiment, the printing system 10 and the correction value setting system 20 that have the printer 100 are mainly discussed. However, the foregoing description also includes the disclosure of a method for setting correction values and a correction value setting apparatus. Disclosure of a printing method and an ink ejection amount correction method is also included. Moreover, the foregoing embodiment is for the purpose of elucidating the invention, and is not to be interpreted as limiting the invention. The invention can of course be altered and improved without departing from the gist thereof, and includes functional equivalents. In particular, embodiments described below are also included in the invention.

Regarding Calculations of Front End Process Area Correction Values, etc.

In the foregoing embodiments, the front end process area correction values and the rear end process area correction values are stored in the correction value storage section 155 and these correction values are read out from the correction value storage section 155 at a time of printing. In regard to this point, it is also possible to store the front end process area provisional correction values and the rear end process area provisional correction values in the correction value storage section 155, then multiply these by the attenuation coefficient at the time of printing.

Regarding Calculations of Combined Correction Values

In the second embodiment, the combined correction values (the front end-side combined correction values and the rear end-side combined correction values) are calculated by the host-side controller 210 of the process-purpose host computer 200' and stored in the correction value storage section 155. In regard to this point, it is also possible to calculate the combined correction values at the time of printing. In this case, the correction value storage section 155 are caused to store the front end process area correction values, the normal process area correction values, and the rear end process area correction values. Then, when printing to the paper S, the host computer 200 (the host-side controller 210) of the printing system 10 is caused to perform the calculations of the above-described expressions (3) through (8) to calculate the combined correction values. It should be noted that in a printer in which a printer driver is installed, it is also possible to carry out the calculations of the combined correction values in the printer.

Regarding Printing System 10

In regard to the printing system 10, a printing system in which the printer 100 serving as the printing apparatus and a computer serving as the print controlling device are configured separately is discussed in the foregoing embodiments. However, the invention is not limited to this configuration. For example, the printing system 10 may include the printing apparatus and the print controlling device as a single unit. Moreover, the printing system may also a printer-scanner multifunctional peripheral which includes a scanner 300 as a single unit is acceptable. With this multifunctional peripheral, it is easy for a user to reset the correction values. That is, it is possible to construct the correction value setting system 20 easily.

Regarding Resetting of Correction Values

Above, description is given concerning setting of the correction values within a process. Namely, description is given concerning setting of the correction values at a time of manufacture. In regard to this point, it is also possible to reset the correction values after shipping.

Regarding Ink

In the foregoing embodiments, six colors of ink are ejected from the head 131. However, the types of inks to be ejected are not limited to these six colors. The types of inks may be different, and the number of colors may be increased. For example, red ink, violet ink, and gray ink may also be included.

Regarding Other Examples of Applications

Although the printer 100 is described in the foregoing embodiments, the invention is not limited to this. For example, technology like that of the present embodiments can also be adopted for various types of recording apparatuses that use inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. Also, these methods and manufacturing methods are within the scope of application.

What is claimed is:

1. A printing method, comprising:

(A) by printing a first area in a test pattern using a first print mode, determining a first correction value corresponding to the first print mode for each of the row regions, based on a first provisional correction value for each of row regions in the first area, the first print mode being a print mode applied to an end area of a medium in a transport direction, and involving repetitively carrying out a movement-and-ejection operation of ejecting ink while moving nozzles in a movement direction that intersects the transport direction and a first transport operation of transporting the medium in the transport direction by a first transport amount, the row regions being a plurality of regions lined up in the transport direction and each being a region in which a dot row is formed along the movement direction by the movement-and-ejection operation, the first provisional correction value being determined based on a density measurement value of each of the row regions in the first area, the first correction value being determined based on a value in which the first provisional correction value is multiplied by an attenuation coefficient, (B) by printing a second area in the test pattern using a second print mode for a plurality of cycles of a period that is determined by a combination of the row region and the nozzle, determining a second correction value corresponding to the second print mode for each of the row regions, based on a second provisional correction value for each of the row regions in the second area, the second print mode being a print mode applied to a middle area of the medium in the transport direction, and involving repetitively carrying out the movement-and-ejection operation and a second transport operation of transporting the medium in the transport direction by a second transport amount, the second provisional correction value being determined based on a density measurement value of each of the row regions in the second area, the second correction value being determined based on a value in which the second provisional correction value is averaged, and (C) in a coexistent segment in which certain row regions and other row regions are mixed, correcting an ejection amount of the ink in each of the row regions using a combined correction value that is obtained as a composition of the first correction value and the second correction value, the certain row regions each being a row region in which the dot row is formed by the first print mode, the other row regions each being a row region in which the dot row is formed by the second print mode.

2. A printing method according to claim 1, wherein the attenuation coefficient by which the first provisional correction value is multiplied is obtained based on a difference between an extent of variance in the first provisional correction values and an extent of variance in the second correction values.

3. A printing method according to claim 1, wherein a composition proportion of the first correction value and the second correction value is determined based on a position of a row region to be corrected in the coexistent segment.

4. A printing method according to claim 3, wherein the coexistent segment is a segment defined on an end area side of the medium, in the transport direction, from a middle area in the transport direction, in which a ratio of the other row regions increases the greater the closeness to the middle area, and a proportion of the second correction values is increased more in row regions on a close side to the middle area than in row regions on a far side from the middle area.

5. A printing method according to claim 1, wherein the first provisional correction value is determined based on a difference between a density measurement value of a row region targeted for setting and a target density, and the target density is determined based on a plurality of density measurement values for the row regions corresponding to a certain instructed tone value, and the second provisional correction value is determined based on a difference between a density measurement value of a row region targeted for setting and a target density, and the target density is determined based on a plurality of the density measurement values for the row regions corresponding to a certain instructed tone value.

6. A printing method according to claim 1, wherein the second print mode is a print mode involving repetitively carrying out the movement-and-ejection operation and the second transport operation in which the medium is transported by the second transport amount greater than the first transport amount.

7. A printing method according to claim 1, wherein the nozzles are arranged in the transport direction having a spacing wider than a spacing between the row regions.

8. A printing apparatus, comprising:

(A) a nozzle moving mechanism that causes a plurality of nozzles that eject ink to move in a movement direction, (B) a transport mechanism that transports a medium in a transport direction that intersects the movement direction, (C) a memory for storing a combined correction value obtained as a composition of a first correction value corresponding to a first print mode and a second correction value corresponding to a second print mode, the first print mode being a print mode applied to an end area of the medium in the transport direction, the first correction value being a correction value for correcting an ejection amount of the ink in each of row regions lined up in the transport direction and being determined for each of the row regions based on a value in which a first provisional correction value is multiplied by an attenuation coefficient, the first provisional correction value being determined for each of the row regions based on a density measurement value of each of the row regions in a first area of a test pattern printed using the first print mode, the second print mode being a print mode applied to a middle area of the medium in the transport direction, the second correction value being a correction value for correcting an ejection amount of the ink in each of the row regions and being determined for each of the row regions based on a value in which a plurality of second provisional correction values are averaged, the second provisional correction values being determined based on a density measurement value of each of the row regions in a second area of the test pattern, the second area being an area in which row regions for a plurality of cycles of a period are printed by the second print mode, the period being determined by a combination of the row region and the nozzle, a plurality of the second provisional correction values corresponding to a same nozzle in each cycle of the period, among the plurality of the second provisional correction values, being a target of averaging, and (D) a controller that controls a movement-and-ejection operation and a transport operation, and that corrects an ejection amount of the ink for each of the row regions, the movement-and-ejection operation being an operation in which the ink is ejected while moving the nozzles, the transport operation being an operation in which the medium is transported in the transport direction, the ink ejection amount correction being carried out on a coexistent segment, in which certain row regions and other row regions are mixed, by using the combined correction value, the certain row regions each being a row region in which a dot row is formed along the movement direction by the first print mode, the other row regions each being a row region in which the dot row is formed by the second print mode.

9. A printing apparatus, comprising:

(A) a nozzle moving mechanism that causes a plurality of nozzles that eject ink to move in a movement direction, (B) a transport mechanism that transports a medium in a transport direction that intersects the movement direction, (C) a memory for storing a first correction value corresponding to a first print mode and a second correction value corresponding to a second print mode, the first print mode being a print mode applied to an end area of the medium in the transport direction, the first correction value being a correction value for correcting an ejection amount of the ink in each of row regions lined up in the transport direction and being determined for each of the row regions based on a value in which a first provisional correction value is multiplied by an attenuation coefficient, the first provisional correction value being determined for each of the row regions based on a density measurement value of each of the row regions in a first area of a test pattern printed using the first print mode, the second print mode being a print mode applied to a middle area of the medium in the transport direction, the second correction value being a correction value for correcting an ejection amount of the ink in each of the row regions and being determined for each of the row regions based on a value in which a plurality of second provisional correction values are averaged, the second provisional correction values being determined based on a density measurement value of each of the row regions in a second area of the test pattern, the second area being an area in which row regions for a plurality of cycles of a period are printed by the second print mode, the period being determined by a combination of the row region and the nozzle, a plurality of the second provisional correction values corresponding to a same nozzle in each cycle of the period among the plurality of the second provisional correction values being a target of averaging, and (D) a controller that controls a movement-and-ejection operation and a transport operation, and that corrects an ejection amount of the ink for each of the row regions, the movement-and-ejection operation being an operation in which the ink is ejected while moving the nozzles, the transport operation being an operation in which the medium is transported in the transport direction, the ink ejection amount correction being carried out on a coexistent segment, in which certain row regions and other row regions are mixed, by using a combined correction value obtained as a composition of the first correction value and the second correction value, the certain row regions each being a row region in which a dot row is formed along the movement direction by the first print mode, the other row regions each being a row region in which the dot row is formed by the second print mode.

* * * * *